US007273269B2

(12) United States Patent
Hawkins et al.

(10) Patent No.: US 7,273,269 B2
(45) Date of Patent: Sep. 25, 2007

(54) SUPPRESSION OF ARTIFACTS IN INKJET PRINTING

(75) Inventors: Gilbert A. Hawkins, Mendon, NY (US); James M. Chwalek, Pittsford, NY (US); Stephen F. Pond, Williamsburg, VA (US)

(73) Assignee: Eastman Kodak Company, Rochester, NY (US)

( * ) Notice: Subject to any disclaimer, the term of this patent is extended or adjusted under 35 U.S.C. 154(b) by 257 days.

(21) Appl. No.: 10/903,051

(22) Filed: Jul. 30, 2004

(65) Prior Publication Data

US 2006/0023011 A1 Feb. 2, 2006

(51) Int. Cl.
*B41J 29/38* (2006.01)
*B41J 2/02* (2006.01)
*B41J 2/07* (2006.01)

(52) U.S. Cl. ..... 347/74; 347/73; 347/11

(58) Field of Classification Search ..... 347/74, 347/75, 78

See application file for complete search history.

(56) References Cited

U.S. PATENT DOCUMENTS

| | | | |
|---|---|---|---|
| 1,941,001 | A | 12/1933 | Hansell |
| 3,373,437 | A | 3/1968 | Sweet et al. |
| 4,347,521 | A | 8/1982 | Teumer |
| 4,384,296 | A | 5/1983 | Torpey |
| 4,613,871 | A | 9/1986 | Katerberg |
| 4,620,196 | A | 10/1986 | Hertz et al. |
| 4,636,808 | A | 1/1987 | Herron et al. |
| 5,224,843 | A | 7/1993 | vanLintel |
| 5,726,772 | A | 3/1998 | Parker et al. |
| 5,875,287 | A | 2/1999 | Li et al. |
| 5,937,145 | A | 8/1999 | Garboden et al. |
| 6,079,821 | A | 6/2000 | Chwalek et al. |
| 6,189,991 | B1 | 2/2001 | Wen et al. |
| 6,367,909 | B1 | 4/2002 | Lean |
| 6,443,549 | B1 | 9/2002 | Bitticker et al. |
| 6,450,628 | B1 * | 9/2002 | Jeanmaire et al. ..... 347/75 |
| 6,460,972 | B1 | 10/2002 | Trauernicht et al. |
| 6,474,784 | B1 | 11/2002 | Fujii et al. |

(Continued)

FOREIGN PATENT DOCUMENTS

EP 1219428 A2 * 7/2002

*Primary Examiner*—Matthew Luu
*Assistant Examiner*—Shelby Fidler
(74) *Attorney, Agent, or Firm*—William R. Zimmerli

(57) ABSTRACT

A method of printing is provided. The method includes providing a travel path comprising a direction of motion of a printhead relative to a recording medium, the printhead having a linear array of nozzles positioned at a nonzero angle relative to the travel path; associating a pixel area of the recording medium with each nozzle of the linear array and a time interval during which a drop ejected from each nozzle can impinge the pixel area of the recording medium; dividing the time interval into a plurality of subintervals; grouping some of the plurality of subintervals into blocks; associating one of two labels with each block, the first label defining a printing drop, the second label defining non-printing drops; associating a drop forming pulse between consecutive selected subintervals of each block having the first label; associating a drop forming pulse between each subinterval of each block having the second label; associating a drop forming pulse between other subintervals, the drop forming pulse being between each pair of consecutive blocks; and causing drops to be ejected from each nozzle based on the associated drop forming pulses.

25 Claims, 21 Drawing Sheets

U.S. PATENT DOCUMENTS 6,478,414 B2 * 11/2002 Jeanmaire ..... 347/77
6,491,362 B1 * 12/2002 Jeanmaire ..... 347/15
6,517,197 B2 * 2/2003 Hawkins et al. ..... 347/74
6,527,375 B2 * 3/2003 Kobayashi et al. ..... 347/55
6,554,410 B2 * 4/2003 Jeanmaire et al. ..... 347/77
6,568,778 B1 * 5/2003 Sekiya et al. ..... 347/9
6,588,888 B2 * 7/2003 Jeanmaire et al. ..... 347/77
6,712,441 B2 * 3/2004 Sato et al. ..... 347/15
6,746,108 B1 * 6/2004 Jeanmaire ..... 347/82
6,851,796 B2 * 2/2005 Jeanmaire et al. ..... 347/74
6,863,385 B2 * 3/2005 Jeanmarie et al. ..... 347/77
6,923,522 B2 * 8/2005 Tanaka et al. ..... 347/41
2003/0202054 A1 10/2003 Jeanmaire

* cited by examiner

SUPPRESSION OF ARTIFACTS IN INKJET PRINTING

CROSS REFERENCE TO RELATED APPLICATIONS

Reference is made to commonly assigned, U.S. patent application Ser. No. 10/903,047 filed Oct. 14, 2004, entitled "CONTINUOUS INKJET PRINTER HAVING ADJUSTABLE DROP PLACEMENT, in the name of Gilbert A. Hawkins, et al., the disclosure of which is incorporated herein by reference.

FIELD OF THE INVENTION

This invention generally relates to digitally controlled printing devices and more particularly relates to suppression of image artifacts of a continuous ink jet printhead that integrates multiple nozzles on a single substrate and in which the breakup of a liquid ink stream into printing droplets is caused by a periodic disturbance of the liquid ink stream.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized by technology as either drop on demand ink jet or continuous ink jet.

The first technology, drop-on-demand technology, provides ink droplets which impact upon a recording surface by using a pressurization actuator (thermal, piezoelectric, etc.). Selective activation of the actuator causes the formation and ejection of a flying ink droplet that crosses the space between the print head and the print media and strikes the print media. The formation of printed images is achieved by controlling the individual formation of ink droplets, as is required to create the desired image. Commonly practiced drop-on-demand technologies use thermal actuation to eject ink droplets from a nozzle. With thermal actuators, a heater, located at near the nozzle, heats the ink causing a quantity of ink to phase change into a gaseous steam bubble, increasing the internal ink pressure sufficiently for an ink droplet to be expelled. As is well known in the art, alternative methods of drop-on-demand droplet ejection use piezoelectric actuators, such as that disclosed in U.S. Pat. No. 5,224,843, issued to vanLintel, on Jul. 6, 1993, bimetallic actuators, such as those disclosed by Lebens et al, U.S. Pat. No. 6,460,972, and electrostatic actuators, as practiced by Seiko Epson, Inc., disclosed in U.S. Pat. No. 6,474,784.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When a print is desired, the ink droplets are directed to strike a print medium. U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This early technique is known as binary deflection continuous ink jet. U.S. Pat. No. 4,636,808, issued to Herron et al., U.S. Pat. No. 4,620,196 issued to Hertz et al. and U.S. Pat. No. 4,613,871 issued to Katerberg disclose techniques for improving image quality in electrostatic continuous ink jet printing including printing with a variable number of drops within pixel areas on a recording medium.

Today's commercialized inkjet printers, whether of the drop-on-demand or continuous inkjet type, are generally not capable of precisely steering droplets to control the placement of droplets precisely within pixels areas of the printed image. In both drop-on-demand and continuous inkjet technologies, failure to accurately control print droplet placement within printed pixel areas reduces the image quality that could be achieved if such control were available. Thus it would be desirable to enable control of the placement of droplets precisely within pixels areas. In some cases, control of drop placement can be used to directly compensate nozzle manufacturing defects which result in drop placement errors, for example by using a lookup table in which manufacturing defects were quantified; in other cases, control of drop placement can be used to directly improve image quality even in the absence of drop placement errors. For example, improvements in image quality can be achieved by deliberately altering the positions of drops within printed pixel areas in an imagewise fashion when printing text. Such alterations can better replicate the intended positions of sharply defined image features such as curved portions of script fonts. Control of drop placement is useful in producing halftone images for graphic arts proofing.

As controlling drop placement has proven difficult, related technologies have been developed to improve image quality that do not require precise control of the positions of drops within printed pixel areas to improve the visual appearance of images. For example, the use of "multiple passes" or "banding passes" in inkjet printers averages out errors in print drop placement that may be inherent in any one nozzle by employing many different nozzles during multiple passes, as will be described. Also, software algorithms can be employed to improve image quality. However, these methods suffer from disadvantages of cost and complexity and the degree to which they improve image quality.

For example, in a printhead with an array of ink nozzles, individual nozzles, differing slightly in fabrication, cause errors in drop placement, either in the direction in which the print head is scanned (fast scan direction) or in the direction in which the receiving medium is periodically stepped (slow scan direction, usually orthogonal to the fast scan direction). For the most part, these minor differences result in placement errors no larger than some fraction of a pixel dimension. Nonetheless, under some conditions, small placement errors within this sub-pixel range of dimensions cause undesirable image artifacts known as banding, most noticeable in areas of text or areas of uniform color. To suppress banding, drop-on-demand inkjet printers in particular use multiple passes (so-called banding passes) in printing images, each banding pass using a different subset of nozzles on the printhead to eject drops. Nozzles are selected dependent on particular algorithms or are selected at random. Repetitive errors in drop placement can thereby be distributed spatially. For example, drops printed in two adjacent lines parallel to the scanning direction of the printhead (fast scan direction) would be printed by many nozzles, each subject to its own slight misdirection and consequent drop misplacement, so as to reduce repetitive misplacements. This technique introduces pseudo random spatial variations in drop position. Such positional "noise" in the printed drop, while itself an image artifact, is generally agreed to be preferred to the case of repetitive misdirection, which is more easily detected by the eye. The use of banding passes is effective even in cases in which misplacements of printed drops change unpredictably with time and/or do not arise from nozzle imperfections. For example, distortion of the media due to wet loading, can result in image artifacts due to misplacement of drops one to another and environmental factors such as mechanical vibrations in the printer or fluctuating air currents near the printhead can also result in image artifacts due to misplacement of drops. While multiple banding passes enable a printhead to correct for known banding errors, a more complex printing pattern is required as well as a more complex medium transport mechanism. The use of banding passes necessarily requires more time to print an image, since not all nozzles are used all the time. Under worst-case conditions, correction for band effects can result in significant loss of productivity, even as high as 10× by some estimates. It should be noted that most continuous inkjet printers do not have scanned printheads and hence cannot easily adapt approaches such as the use of banding passes common in drop-on-demand printers.

Conventional software methods, which do not necessarily reduce productivity, can also be applied to improve image quality. These well-known techniques include dither matrices, blue noise masking, FM screening, and error diffusion. For example, U.S. Pat. No. 5,726,772 entitled "Method and Apparatus for Halftone Rendering of a Gray Scale Image Using a Blue Noise Mask" to Parker et al. discloses the use of ordered dither algorithms using fixed-size threshold screen patterns. U.S. Pat. No. 5,875,287 entitled "Banding Noise Reduction for Clustered-Dot Dither" to Li et al. discloses an improved method for minimizing banding artifacts using offset dither matrices. U.S. Pat. No. 6,443,549 entitled "Continuous Tone Reproduction Using Improved Ink Jet Droplet Dispersion Techniques" to Bitticker et al. discloses a hybrid dot placement scheme using different types of dot dispersion, such as error diffusion and dither matrices, based on the overall density of an area of the image. As yet another approach, U.S. Pat. No. 5,937,145 entitled "Method and Apparatus for Improving Ink-Jet Print Quality Using a Jittered Print Mode" to Garboden et al. discloses the employment of "jittering" algorithms to vary droplet timing in a scanning inkjet printer of the drop-on-demand type. While the software solutions of these prior art methods are able to provide some measure of help for reducing banding and other image artifacts, there are limitations to these solutions and some room for improvement. Specifically, limitations of the print hardware constrain the level of adjustability to one or more full pixel-to-pixel distances, rather than allowing movement over a fraction of a pixel. Dither matrices, blue noise, and other techniques are limited by hardware-imposed constraints, such as the inability to control individual nozzles in a row or matrix. Therefore, these existing methods manipulate the image data before sending it to the printer in order to compensate for characteristics of the imaging system. Improvement of printer hardware performance itself, including methods to control drop placement within pixel areas could alleviate at least some of the need to implement these software solutions in many types of imaging applications.

It can be seen from the above discussion that the ability to accurately control print droplet placement within printed pixel areas could provide valuable alternatives to techniques currently used to improve image quality or to supplement those techniques when used in combination with them.

Some progress has been made in this regard in the case of continuous inkjet printing. For example, although early continuous ink jet printing technologies were not capable of steering droplets ejected from individual nozzles so as to accurately position printed drops within printed pixel areas, later continuous inkjet technologies were disclosed which provided methods for controlling the placement of droplets in both the slow scan and fast scan directions precisely within pixels areas of the printed image:

U.S. Pat. No. 4,347,521 (Teumer) discloses a print head employing a complex set of electrodes for droplet deflection in a continuous ink jet apparatus so that a plurality of inkjet nozzles are able to print in the same pixel area;

U.S. Pat. No. 4,384,296 (Torpey) similarly discloses a continuous ink jet print head having a complex arrangement of electrodes about each individual print nozzle for providing multiple print droplets from each individual ink jet nozzle;

U.S. Pat. No. 6,367,909 (Lean) discloses a continuous ink jet printing apparatus employing an arrangement of counter electrodes within a printing drum for correcting drop placement;

U.S. Pat. No. 6,517,197 (Hawkins et al.) discloses an apparatus and method for corrective drop steering in the slow scan direction for a continuous ink jet apparatus using a slow-scan droplet steering mechanism that employs a split heater element;

U.S. Pat. No. 6,079,821 (Chwalek et al.) discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets whose trajectories can be controlled and non-printed ink droplets; and U.S. Pat. No. 6,588,888 (Jeanmaire et al.) discloses a continuous ink jet printer capable of forming droplets of different size and with a droplet deflector system for providing a variable droplet deflection for printing and non-printing droplets.

While the above cited patents disclose methods for placing droplets precisely within pixel areas of the printed image in both the slow scan and fast scan directions, they require special nozzle designs and/or hardware which adds cost and complexity. Thus despite the cited improvements, technology for precisely controlling drop placement within pixel areas has not been commercialized due to cost and complexity. The capability of cost effectively providing precise control of drop placement in the fast scan direction, as described in commonly assigned copending U.S. application Ser. No. entitled "Continuous Inkjet Printer Having Adjustable Drop Placement" cost effectively affords partial control of droplet placement within pixel areas for continuous inkjet printers but provides only one-dimensional correction of droplet placement thereby allowing only a partial set of solutions for improving image quality.

Additionally, not all prior art solutions can be applied to a continuous ink jet printing apparatus, particularly for corrections in placement less than the center to center spacing of drops printed in succession and particularly where such an apparatus does not employ electrostatic forces for droplet deflection. Taken by themselves, none of these solutions meet all of the perceived requirements for robustness, sub-pixel placement accuracy, and cost. In particular, there remains significant room for improvement in controlling droplet placement in both orthogonal fast and slow scan directions. Specifically, there are advantages to a solution that would allow, at any position within a pixel area:

(a) control of the centroid of the printed drop anywhere within its associated pixel area;

(b) control of the number of droplets used to form a printed drop; and (c) control of the spread of each printed drop.

Thus it can be appreciated that there is a continuing need for cost effective control capabilities for improved dot positioning for each ink jet nozzle in a continuous ink jet print head, particularly where these added capabilities can be used to suppress imaging artifacts.

SUMMARY OF THE INVENTION

According to a feature of the present invention, a method of printing comprises providing a travel path comprising a direction of motion of a printhead relative to a recording medium, the printhead having a linear array of nozzles positioned at a nonzero angle relative to the travel path; associating a pixel area of the recording medium with each nozzle of the linear array and a time interval during which a drop ejected from each nozzle can impinge the pixel area of the recording medium; dividing the time interval into a plurality of subintervals; grouping some of the plurality of subintervals into blocks; associating one of two labels with each block, the first label defining a printing drop, the second label defining non-printing drops; associating a drop forming pulse between consecutive selected subintervals of each block having the first label; associating a drop forming pulse between each subinterval of each block having the second label; associating a drop forming pulse between other subintervals, the drop forming pulse being between each pair of consecutive blocks; and causing drops to be ejected from each nozzle based on the associated drop forming pulses.

The current invention discloses a novel solution that provides a low cost means to control drop placement in both slow and fast scan directions. This capability, hitherto unavailable cost effectively, enables compensation for tolerance and alignment faults of individual print head nozzles and for the improvement in image quality even for printers with printheads having no faults. In addition to allowing sub-pixel positional control in both the slow scan direction and the fast scan direction, the ink jet print head apparatus and methods disclosed enable image processing algorithms to be employed for correcting various types of imaging artifacts.

The present invention provides a subdivided interval for droplet formation, allowing a number of flexible timing arrangements for droplet delivery from each individual inkjet nozzle and enabling a compact means of representing and controlling such timing arrangements.

It is an advantage of the present invention that it provides positional control for each individual nozzle of a print head upon each printing operation to within sub-pixel dimensions. It is another advantage of the present invention that it provides a method for suppressing imaging artifacts even for printers in which the printhead is not scanned. It is a further advantage of the present invention that it allows randomized print droplet placement to within sub-pixel dimensions.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which:

FIG. 3*c* is a timing diagram showing an arrangement of the subdivisions of FIG. 3*a*, grouped into blocks;

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

Figure 1A:
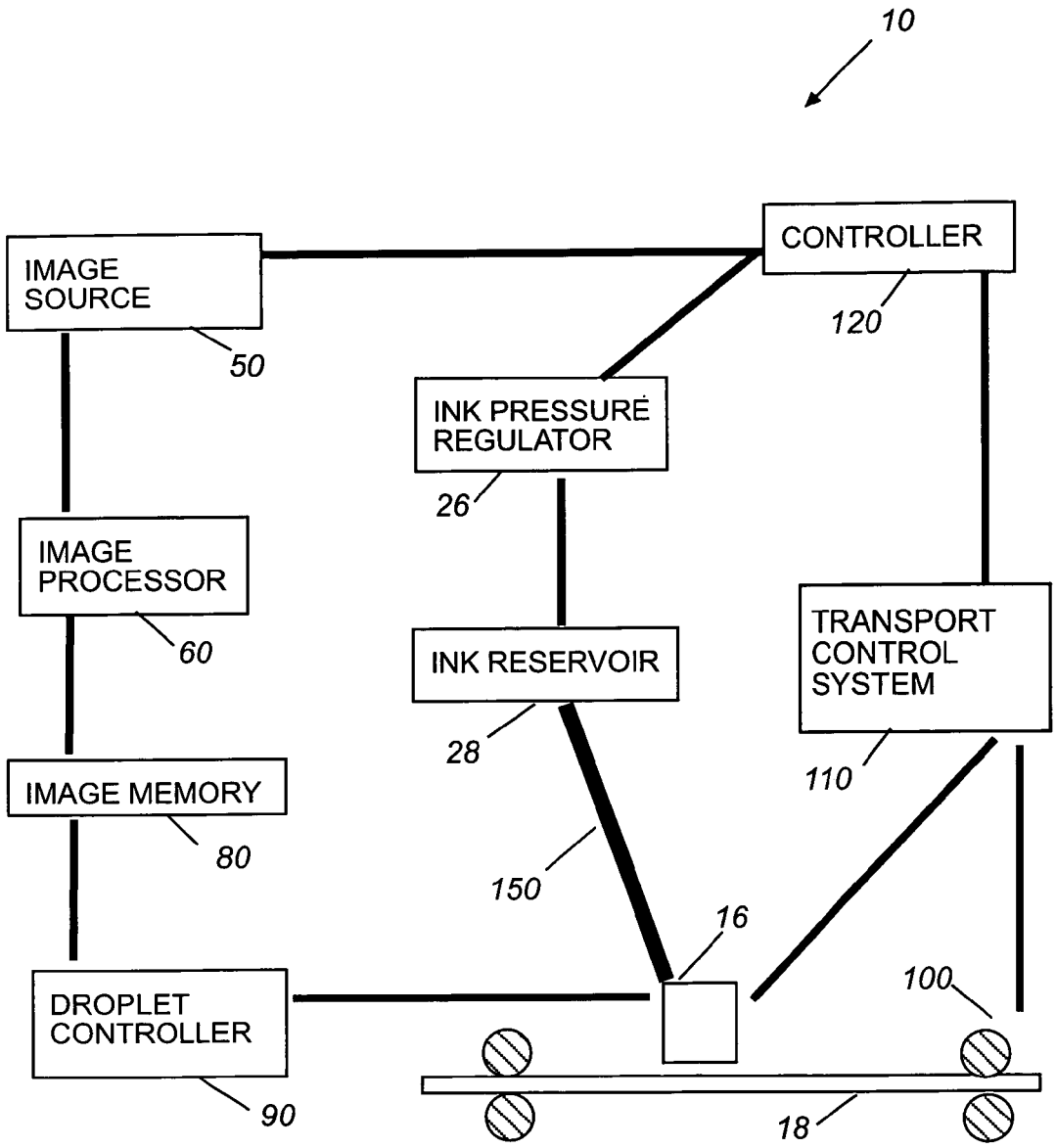
FIG. 1*a* shows a simplified block schematic diagram of one exemplary printing apparatus according to the present invention.
Figure 1B:
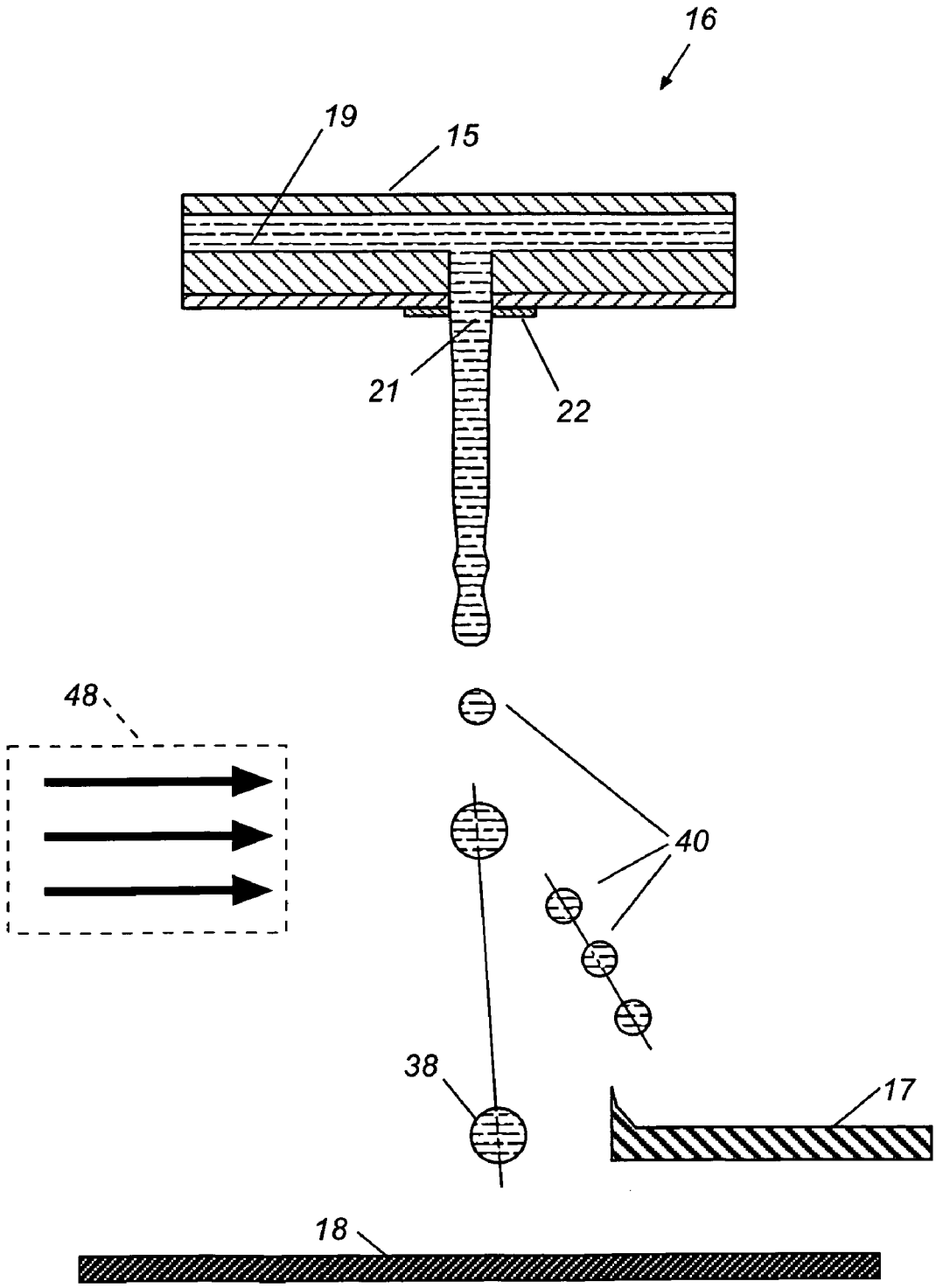
FIG. 1*b* shows a cross-section of a prior art printhead shown as part of FIG. 1*a;*

Referring to FIG. 1*a*-1*b*, there is shown an imaging apparatus 10 capable of controlling the trajectory of fluid droplets according to the present invention. Imaging apparatus 10 accepts image data from an image source 50 and processes this data for a print head 16 in an image processor 60. Image processor 60, typically a Raster Image Processor (RIP) or other type of processor, converts the image data to a pixel-mapped page image for printing. During printing operation, a recording medium 18 is moved relative to print head 16 by means of a plurality of transport rollers 100, which are electronically controlled by a transport control system 110. A logic controller 120 provides control signals for cooperation of transport control system 110 with an ink pressure regulator 26. Droplet controller 90 provides the drive signals for ejecting individual ink droplets from print head 16 to recording medium 18 according to the image data obtained from image memory 80. Image data may include raw image data, additional image data generated from image processing algorithms to improve the quality of printed images, and data for drop placement corrections, which can be generated from many sources, for example, from measurements of the steering errors of each nozzle 21 in printhead 16, as is well known to one skilled in the art of printhead characterization and image processing. Image memory 80 can therefore be viewed as a general source of data for drop ejection, such as the desired volume of ink drops to be printed, the exact location of printed drops, and shape of printed drops, as will we described.

Ink pressure regulator 26, if present, regulates pressure in an ink reservoir 28 that is connected to print head 16 by means of a conduit 150. It may be appreciated that different mechanical configurations for receiver transport control may be used. For example, in the case of page-width print heads, it is convenient to move recording medium 18 past a stationary print head 16. On the other hand, in the case of scanning-type printing systems, it is more convenient to move print head 16 along one axis (i.e., a sub-scanning direction usually referred to as the fast scan direction) and recording medium 18 along an orthogonal axis (i.e., a main scanning direction usually referred to as the slow scan direction), in relative raster motion.

For an understanding of the method of the present invention, it is important to observe that there is a close relationship between the timing of droplet formation and release at print head 16 (FIGS. 1*a*, 1*b*) and the positional placement of that droplet to form a printed drop 32 (FIG. 2) on recording medium 18. This timing and related factors such as the volume of printing droplet 38 (FIG. 1*b*), deflective forces acting upon printing droplet 38 when it is formed and during its flight time, speed of printing droplet 38, and distance between print head 16 and recording medium 18 all play a part in effecting the desired positioning of printing droplet 38 onto recording medium 18. The basic computations used for calculating the effects of each of these factors are relatively straightforward and are well known to those skilled in the inkjet printing arts.

It is also important to recognize that there is a close relationship between the signals provided to each nozzle of the printhead, for example signals in the form of voltage pulses carried on one or more wires connecting an image data source to the printhead or signals in the form of optical pulses carried by a fiber optic cable connecting the image data source to the printhead, and the timing of droplet formation and release at print head 16. The signals are typically represented as pulses in a timing diagram, as described later, and the timing diagram for signals arriving at a particular nozzle is thus closely related to the spatial pattern of droplets ejected from the nozzle and thus to the positional placement of the droplets on the recording medium.

Figure 2:
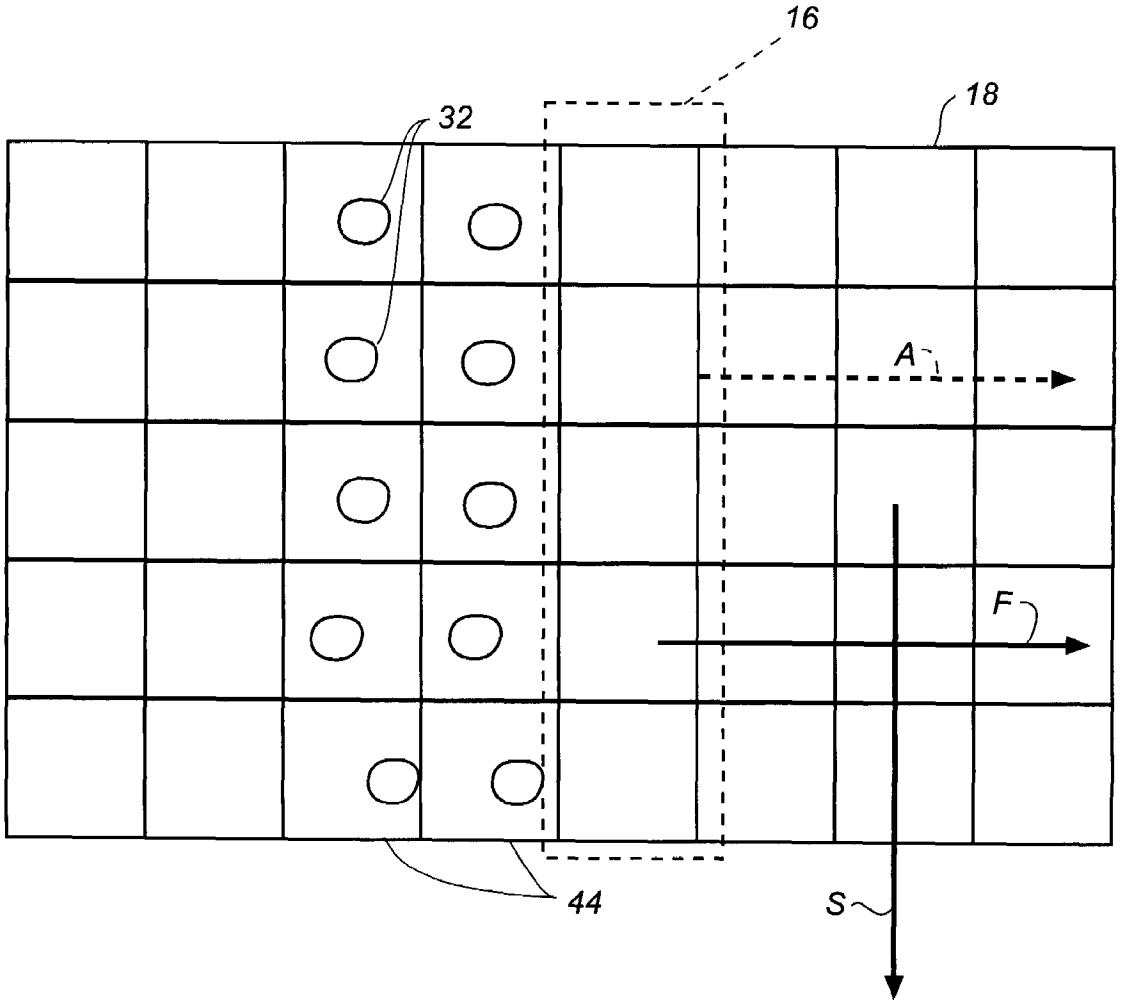
FIG. 2 is a plane view showing a portion of an array of printed droplets relative to the position and motion of the print head.

Referring to FIG. 2, there is shown a plane view of a small number of printed drops 32 printed by print head 16 within pixel areas 44 on recording medium 18. Ideally, in the example of FIG. 2, each printed drop 32 is centered within its corresponding pixel area 44. However, as is represented in FIG. 2, not all printed drops 32 in any sampling meet this ideal condition, due to manufacturing imperfections, for example. Of particular interest with respect to the present invention is printed drop 32 positioning with respect to fast scan direction F of print head 16, slow scan direction S, and the directions of a deflecting air flow A (U.S. patent application Publication No. 2003/0202054).

As is described in the above-cited disclosures of '595 Anagnostopoulos et al. and '362 Jeanmaire patents, printhead 16 provides a continuous stream of ink droplets. The continuous flow ink jet printer directs printing droplets to the surface of recording medium 18 and deflects non-printing droplets to a catcher, gutter, or similar device using the deflecting air flow which flows in the direction A. The apparatus and method of the present invention uses the same basic droplet formation and deflection methods of these earlier patents, and also provides improved droplet timing techniques and improved techniques for quantifying image data in order to position and shape droplets with in pixel areas on a recording medium.

Figure 3A:
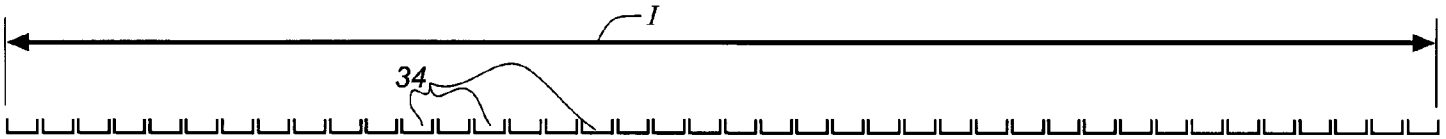
FIG. 3*a* is a timing diagram showing subdivision of time interval I into subintervals with an enlargement of the left portion of interval I for clarity.
Figure 3B:
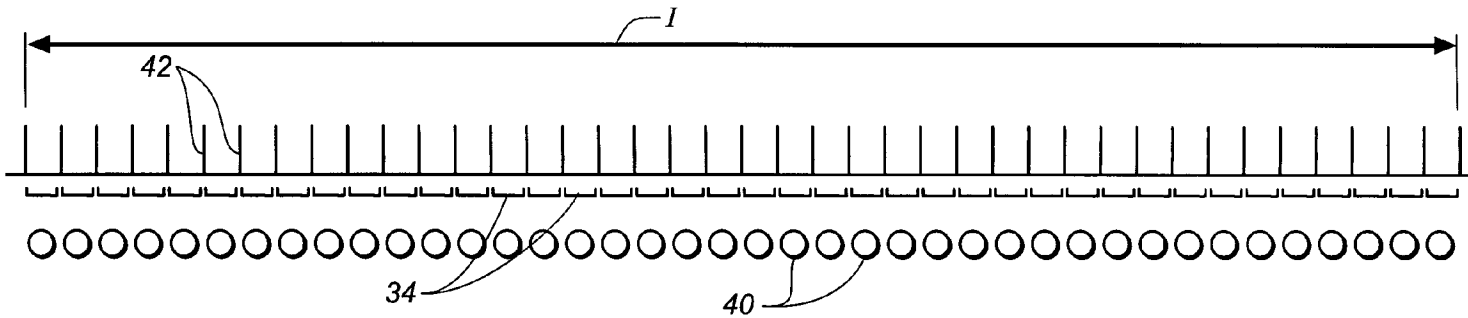
FIG. 3*c* is a timing diagram showing subdivision of time interval I into subintervals having drop forming pulses between adjacent subintervals resulting in a series of non-printing droplets (filled circles) traveling in air.

Referring now to FIG. 3*a*, there is shown a timing diagram corresponding to a time interval I which has been divided into a plurality of subintervals 34, shown of equal duration in FIG. 3*a* and in the enlargement of FIG. 3*a* included for clarity. During a particular time interval I. drop forming pulses 42 can be provided between adjacent subintervals 34. Such drop forming pulses are represented schematically in FIG. 3*b*, which illustrates the case of drop forming pulses 42 placed between all adjacent subintervals. In FIG. 3*a* and 3*b* and in subsequently shown timing diagrams, time increases left to right. Certain patterns of drop forming pulses can cause printing drops 38 to form at particular nozzles on printhead 16 of FIG. 1*a*-1*b*, as a result of the drop forming pulses being sent to printhead 16. Other patterns of drop forming pulses can cause non-printing drops 40 to form at nozzles on printhead 16. Drop forming pulses 42 are provided by droplet controller 90 of FIG. 1*a* and are typically voltage pulses sent to printhead 16 through electrical connectors, as is well known in the art of signal transmission. However, other types of pulses, such as optical pulses, may also be sent to printhead 16, to cause printing and non-printing droplets to be formed at particular nozzles, as is well known in inkjet printing. Once formed, printing drops 38 travel through the air to a recording medium and later impinge on a particular pixel area 44 of the recording medium which is thereby associated with interval I.

FIG. 3*b* shows the case in which drop forming pulses 42 are placed between all adjacent subintervals in time interval I, which results in the formation of a series of non-printing droplets 40, represented by small filled circles in FIG. 3*b*, such non-printing droplets being ejected from a particular nozzle on printhead 16. Each non-printing droplet 40 in FIG. 3*b* can be said to have been produced by drop forming pulses at the beginning and end of the particular subinterval 34 shown above the non-printing droplet 40, the drop forming pulse at the beginning of the subinterval being a leading pulse for the subinterval 34 and a the drop forming pulse at the end of the subinterval 34 being a trailing pulse for subinterval 34. As described in U.S. Pat. Nos. 6,491,362 and 6,079,821, the non-printing droplet is formed some time after the leading and trailing pulses have been transmitted to printhead 16. Thus the small solid dots shown below the timing diagram of pulses in FIG. 3*c* are drawn to represent schematically the correspondingly formed ink droplets ejected from a particular nozzle and later moving as a stream of drops through the air.

Printing droplets 38 and non-printing droplets 40 are formed as a result of drop forming pulses acting on the fluid column ejected from the printhead, as disclosed in the above-referenced '821 Chwalek et al. and '197 Hawkins et al. patents describing the formation of droplets at print head. In those cases, the drop forming pulses are typically voltage pulses which produce heat pulses at the printhead nozzles, thereby forming droplets.

Figure 3C:
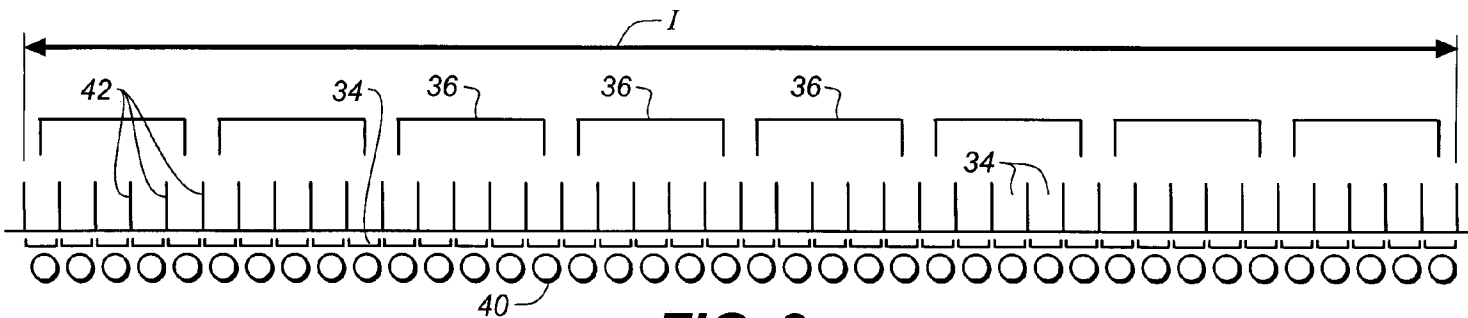

FIG. 3*c* illustrates the way imaging data from image memory 80 (FIG. 1) containing information on a printed drop desired to be printed on a particular pixel area 44 is used by droplet controller 90 (FIG. 1) to send patterns of drop forming pulses to printhead 16, whereupon any printing droplets once formed will travel through the air and impinge on a pixel area 44 corresponding to interval I on recording medium 18. Of course printing an image on a portion of recording medium 18 comprising many pixel areas requires many repetitions of this process over many time intervals and many nozzles, as is well known in the art of inkjet printing. Referring to FIG. 3*c*, there is represented a time interval I corresponding to the time available for providing pulses for forming a printed drop 32 comprising one or more printing droplets 38 (FIG. 2) ejected from a particular nozzle of printhead 16 in response to patterns of drop forming pulses represented by vertical marks in interval I. Subintervals 34 in interval I are grouped into a plurality of blocks 36. In this particular case, each block 36 comprises five subintervals 34. For this example, then, interval I has a total of 40 subintervals 34, grouped in eight blocks 36. As is shown in FIG. 3*c*, each block 36 contains four drop forming pulses 42 and there is a single drop forming pulse labeled 43 between each block 36. The function of drop forming pulses labeled 43 lying between blocks is described subsequently. In the case shown in FIG. 3*c* and all cases subsequently discussed, drop forming pulses 42 within blocks 36 and drop forming pulses 43 between blocks 36 occur between adjacent subintervals 34. Typically, drop forming pulses 42 and 43 are the same, although this is not required, except for their location within or between blocks 36. For example, it is within the scope of the present invention that pulses 43 are of higher voltage than pulses 42, in order to more perfectly form printing drops.

It is to be understood that although FIG. 3*a* and subsequent similar figures showing an interval I show blocks 36 beginning and ending within a subinterval 34 for clarity, it is also within the scope of the present invention that the time between the end of a block and the end of the last subinterval contained at least partially within the block can be arbitrarily small. Likewise, although the time between the end of one subinterval 34 and the beginning of the next is shown for clarity in FIG. 3*a* and 3*c* as a substantial fraction of the subinterval, it can be arbitrarily small. Similarly, the time between blocks is shown for clarity to be about the same as the duration of a subinterval but can in fact be arbitrarily small.

The grouping of subintervals 34 into blocks 36 is employed in the present invention to efficiently use image data to produce desired drop forming pulse arrangements in interval I which can cause one or more printing droplets 38 to be placed within a corresponding pixel area 44, corresponding, for example, to the a pixel of information, a plurality of which generally comprise digital images.

In FIG. 3*c*, the drop forming pulses 42 are present between all subintervals in all blocks and drop forming pulses 43 are present between all blocks. In this case, printhead 16, in response to drop forming pulses, typically voltage pulses carried by connecting wires, produces a continuous series of non-printing droplets, as described in the above-referenced '821 Chwalek et al. and '197 Hawkins et al. patents describing the formation of droplets at print head.

Figure 4A:
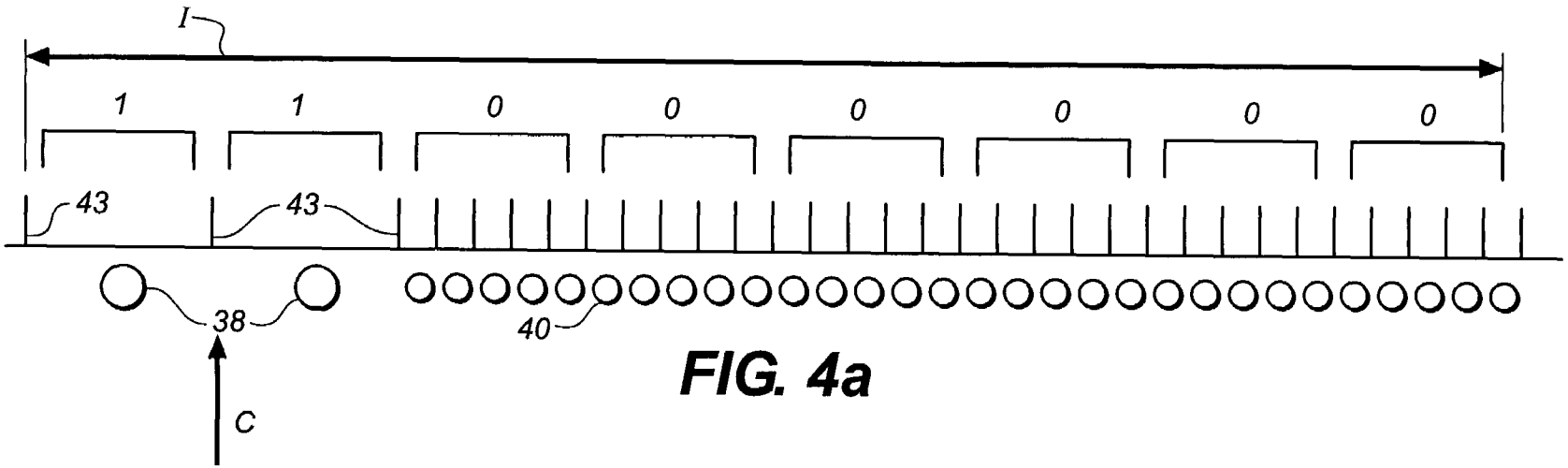
FIGS. 4*a*-4*b* are timing diagrams illustrating different arrangements of droplet formation where two printing droplets form a printed drop on a recording media.

Referring now to FIG. 4*a*, there is shown a timing diagram with a more complex droplet arrangement in interval I. This case differs from that of FIG. 3*c* in that the first two blocks 36 contain no drop forming pulses 42 between subintervals lying entirely within each block. Here, two printing droplets 38 are formed early during interval I, followed by a succession of non-printing droplets 40, the mechanism of formation of the printing drops being described in the above-referenced '821 Chwalek et al. The two printing droplets 38 are said to form a printed drop 32 in the associate pixel area 44.

As the annotation of FIG. 4*a* indicates, in accordance with the present invention blocks 36 that form printing droplets 38 are represented as a binary "1." Blocks 36 containing non-printing droplets 40 are represented as binary "0." Thus, the data string "11000000," a single 8-bit byte of data, can be used to represent the droplet arrangement of FIG. 4*a*. Referring to the corresponding printed drop placement diagram of FIG. 5*a*, there is shown the position of printed drop 32 within pixel area 44 for the droplet arrangement of FIG. 4*a*, comprising two printing droplets 38. When printed, printing droplets 38 tend to coalesce and form a single printed drop 32 having a center position or centroid of ink density shown as C in FIG. 5*a*, on recording medium 18, as is well known in the art of inkjet printing. Centroid C on recording medium 18 measures the average spatial location of the deposited ink. The centroid of the printed ink drops can be defined as that location at which the density of deposited ink weighted by its distance from the centroid is equal in all directions from C. Likewise, in terms of the timing diagram of FIG. 4*a*, a centroid for the pulse sequence for forming printing drops in time can be said to correspond to the point in time midway between the two blocks 36 labeled "1" of interval I, that is the point in time midway between the time at which the first and second printing droplets are formed. Similarly, in terms of the drops shown as filled circles in FIG. 4*a*, corresponding to printing droplets 38 traveling along a trajectory through the air, a centroid C of the traveling printing drops can be said to be the spatial location midway between the printing droplets 38 as they travel through the air; or, in general, as the location at which the density of ink weighted by its distance from the centroid is equal along both directions of the droplet trajectories.

Other related definitions of a centroid are possible, as can be appreciated by one skilled in the art of inkjet printing; but in general the concept of a centroid is useful in discussing the dependence of the location of drops printed on a recording medium on the sequence of drop forming pulses. As can be appreciated by one skilled in the art of ink droplet printing, knowledge of the centroid of printing drops, the velocity of the drops, the motion of the recording medium, and the way the ink and media interact allows calculation of the spatial centroid of ink density on the recording medium.

Figure 5A:
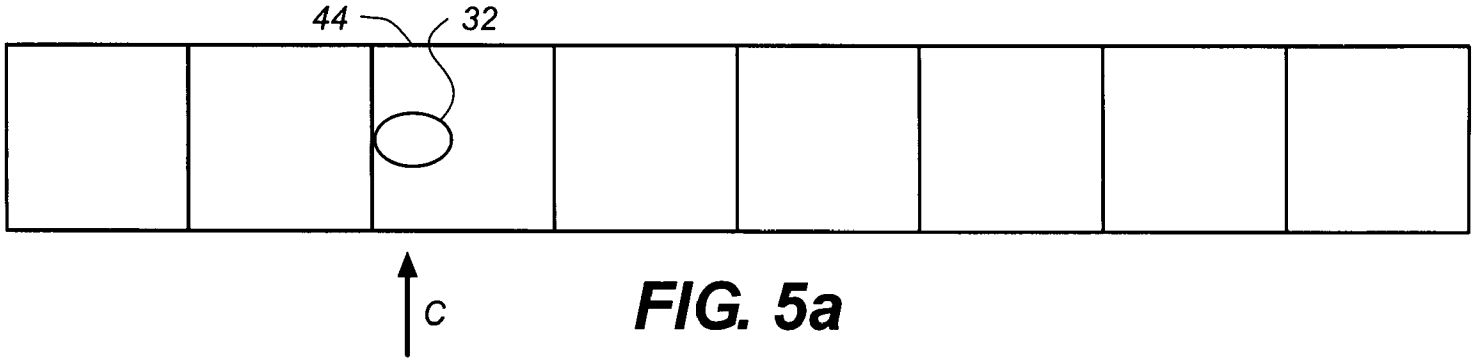
FIGS. 5*a*-5*b* are plan views showing printed drops in pixel areas of a recording medium corresponding to the timing diagrams of FIGS. 4*a*-4*b;*

In the arrangement of FIG. 4*a*, drop forming pulses 43 act as leading and trailing drop forming pulses for printing droplets 38, indicated schematically by the solid dots in FIG. 4*a*. In other words, printing droplets 38 were formed as a result of those drop forming pulses acting on the fluid column ejected from the printhead, as disclosed in the above-referenced '821 Chwalek et al. In FIG. 5*a*, spatial centroid C is dependent upon the timing centroid C of FIG. 4*a*, allowing the position of spatial centroid C to be adjusted by manipulating this timing arrangement for forming printing droplets 38. Spatial centroids C of printed drops 32 can thereby be flexibly and accurately moved in the fast scan direction F of FIG. 2 as described below.

Figure 4B:
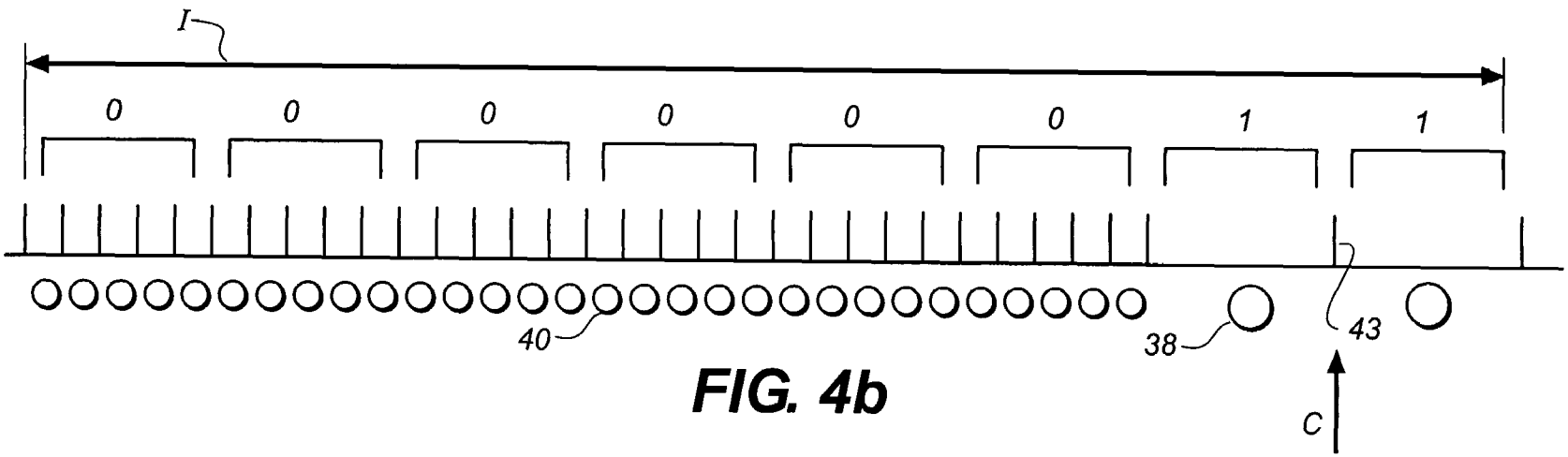
Figure 5B:
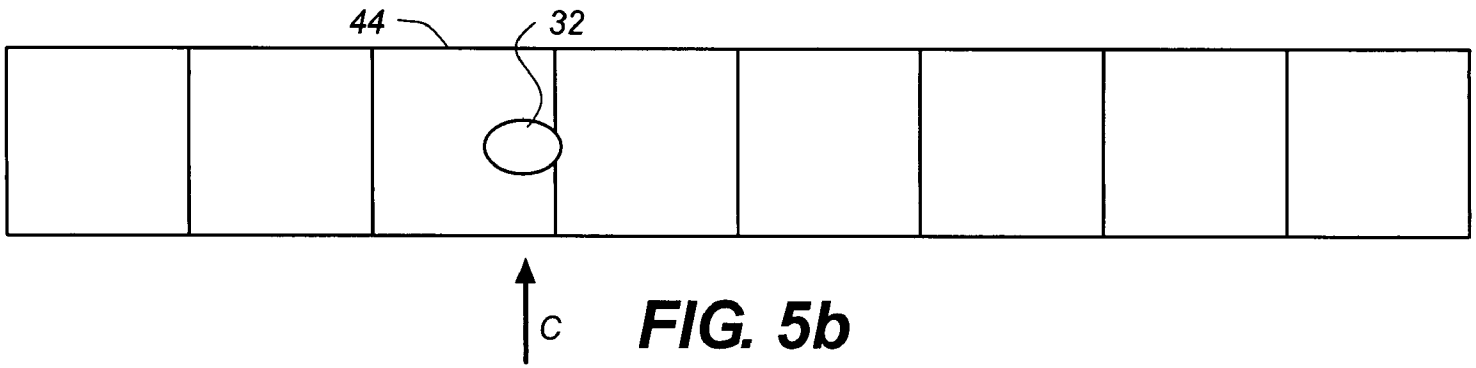

For example, FIG. 4*b* and its corresponding printed drop placement diagram 5*b* show an alternate arrangement of two printing droplets 38 within interval I and show how this timing impacts their relative placement in forming printed drop 32. As with FIGS. 4*a* and 5*a*, centroid C is also indicated. Binary data strings differ between these sequences, as shown. Spatial centroid C of the printed drops 32 is seen to be moved in its associated pixel area in the fast scan direction F in FIG. 5*b* compared to its position in FIG. 5*a*, in accordance with the binary representation of 1's and 0's in FIGS. 4*a*-4*b*, due to the fact that the blocks 36 corresponding to printing droplets 38 occur at different times and to the fact that the receiving medium moves relative to the print head in direction F. A more detailed discussion of controlling the positioning of the centroid of printed drops in accordance with timing diagrams similar to FIGS. 4*a*-4*b* is given in copending U.S. application Ser. No. 10/903,047 the teachings of which are incorporated herein. Alteration of the sequence of drop forming pulses does not change the position of the centroid of printed drops in the direction perpendicular to the fast scan direction, which is generally the slow scan direction S shown in FIG. 5*a* and 5*b*.

As discussed in copending U.S. application Ser. No. 10/903,047, the position of the centroid of printed drops within pixel areas may also be controlled in the fast scan direction by providing that the printing droplets are differently sized, and the teachings of this technique are incorporated in the present application. Alteration of the sizes of printing drops does not change the position of the centroid of printed drops in the direction perpendicular to the fast scan direction, i.e. in the slow scan direction S shown in copending U.S. application Ser. No. 10/903,047, because the direction of airflow A is aligned with the fast scan direction F. Differently sized drops are deflected by different amounts in the direction A by the airflow.

Figure 6:
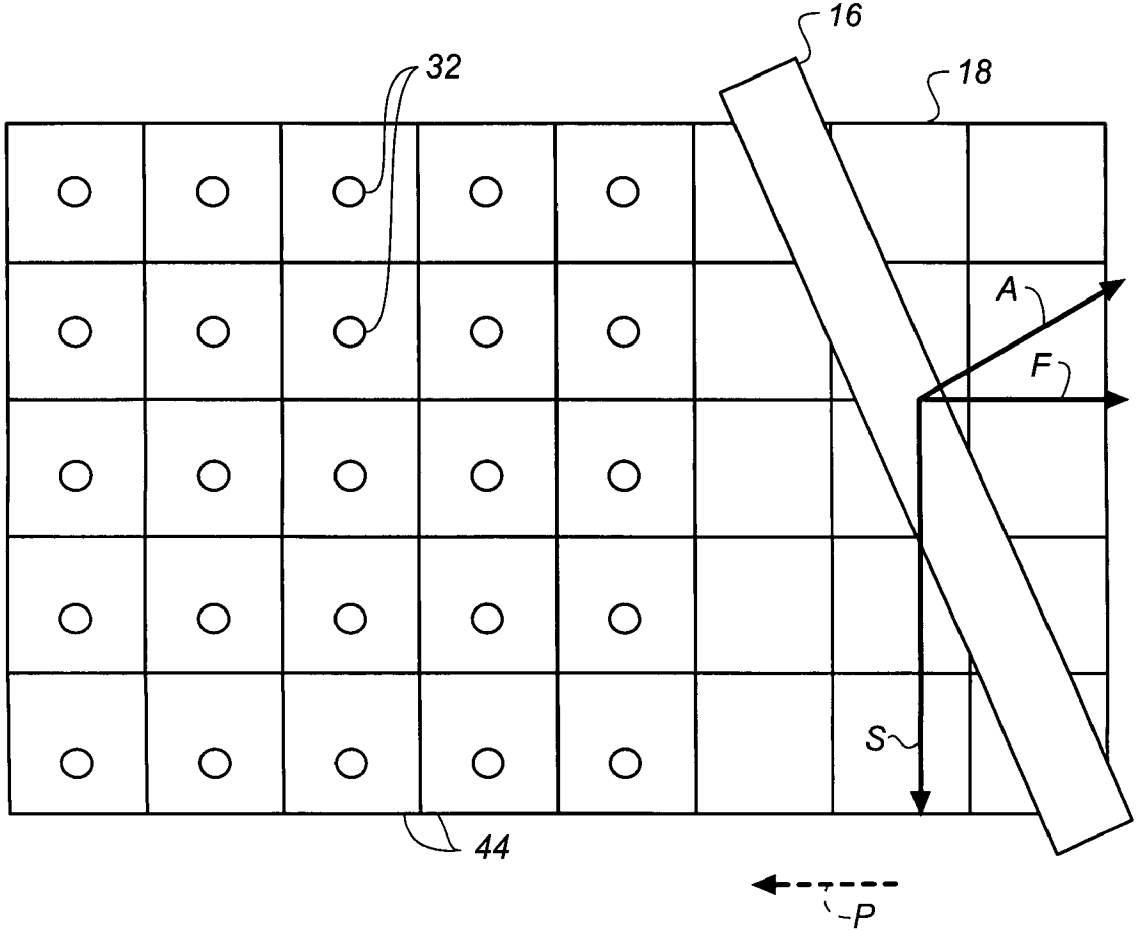
FIG. 6 is a plane view showing one arrangement for tilting the print head with respect to the fast scan direction.

We next describe how the present invention allows control of the position of printed drops not only in the fast scan direction F but also in the direction perpendicular to F, that is in the slow scan direction S, thus allowing printed drops to be positioned anywhere within their respective pixel areas. Referring to FIG. 6, there is shown a plan view of a small number of printed drops 32 printed by print head 16 (shown in phantom lines) within pixel areas 44 on recording medium 18, the printhead being oriented in accordance with the present invention a an angle with respect to the fast scan direction F. Each ink jet nozzle of print head 16 prints a row 56 of printed drops 32. Ideally, each printed drop 32 is centered within its corresponding pixel area 44. Of particular interest with respect to the present invention is the positioning of printed drops 32 in two directions within corresponding pixel areas 44, the fast scan direction F and the slow scan direction S in FIG. 6. The fast scan direction F is the direction of scanning of print head 16. As is described above and in commonly assigned copending U.S. application Ser. No. 10/903,047, positioning relative to fast scan direction F is a function of the timing of printing droplet release and scanning speed. The slow scan direction S is in the direction of the line of ink jet nozzles on print head 16. In accordance with the present invention, the continuous inkjet printhead is angled with respect to the fast scan direction as shown in FIG. 6, preferably by an amount of about 45 degrees. When the head is angled such that the direction of airflow A is no longer in the fast scan direction F, the timing methods discussed above allow printed drop 32 positioning in both the fast and slow scan directions. It should be noted that an additional effect, related to the current invention, of adjustment of the angle of print head 16 relative to fast scan direction F is that higher printing resolution is provided in the slow scan direction, since the nozzle to nozzle distance of print head 16 in the slow scan direction is decreased by a factor of the cosine of the angle of head rotation, as is known in the art of inkjet printing.

Referring to FIG. 6, the direction of deflecting air flow A for angled print head 16 is no longer in the fast scan direction. Angling print head 16 relative to fast scan direction F, as shown in FIG. 6, and also changing the volume of printing droplets 38, as shown in FIGS. 7*a*-7*d*, are now combined in accordance with the present invention to provide further positioning options for printing droplets 38 within their associated pixel areas, specifically to provide for altering the position of the centroid of printed drops with pixel areas in both the fast and slow scan directions. Referring now to the timing diagrams of FIGS. 7*a*-7*d* and the corresponding spatial position diagrams of FIGS. 8*a*-8*d*, the relative effects of orienting print head 16 at an angle to the fast scan direction while altering the sequences of drop forming pulses are illustrated. In a manner similar to the pulse timing sequences discussed in association with FIGS. 9*a*-9*d* and FIGS. 10*a*-10*d* of copending U.S. application Ser. No. 10/903,047, the timing diagrams of FIGS. 7*a*-7*d* generate printing droplets 38 having different volumes due to the fact that for certain of the blocks 36, a specific number of consecutive subintervals have no drop forming pulses 42 between them. Specifically, in the cases corresponding to FIGS. 7*a*-7*d*, there are 5, 6, 7 and 8 subintervals respectively have no drop forming pulses between them. Possible representations of these sequences are indicated as "00044, ""00033,""00022," and "00011" above the blocks. Other mathematical ways of representing the pulse sequences are of course possible and within the intent of the present invention, including representations using data compression. Deflecting air flow A at print head 16 (FIG. 6) has a different impact on the relative trajectories of these printing droplets 38, depending on their volumes, as described by the Jeanmaire et al. '566 patent. In particular, printing droplets 38 of a larger volume, for example those formed by the pulse sequences of FIG. 7*d*, are deflected less in direction A of FIG. 6 in comparison with printing droplets 38 of smaller volumes, for example those formed by the pulse sequences of FIG. 7*a*, and thereby printed drops 32 are altered in their positions within their associated pixel areas in the direction A, which is substantially orthogonal to fast scan direction F. It should be noted that in Figs 7*a*- 7*c*, the printing drops formed during a specific number of consecutive subintervals having no pulses could equally well have been formed at the end of the associated block, rather than at the beginning, since the printing drops are formed whenever a sufficient number of consecutive subintervals contain no pulses.

It is important to note that orienting print head 16 at an angle to the fast scan direction does not change the direction of alteration of placement of printed drops within their associated pixel areas when the alteration is due to timing of the drop forming rather than due to changes in the volumes of printing drops. The effects of controlling the timing of the formation of printing drops, for example as illustrated by the difference between FIG. 4*a* and 4*b*, still controls the position of the printed drops within their associated pixel areas only in the fast scan direction, since the direction of scanning of each nozzle with respect to the recording medium is unchanged and since the change in direction of airflow A, while affecting all drops, does not affect them based on the time of their formation. By way of illustration, the effect of advanced timing, that is the formation of printing drops at an earlier time rather than at a later time, is shown for the angled printhead in the comparison of FIGS. 8*d* and 8*e*; the position of the printed drop being moved in the direction of page travel P, substantially in the fast scan direction. Thus, in accordance with the present invention, by controlling the timing of the formation of printing droplets as previously described as well as by controlling the volume of printing droplets, the location of printed drops 32 in their associated pixel areas may be arbitrarily controlled in both fast and slow scan directions on the recording media.

Figure 7A:
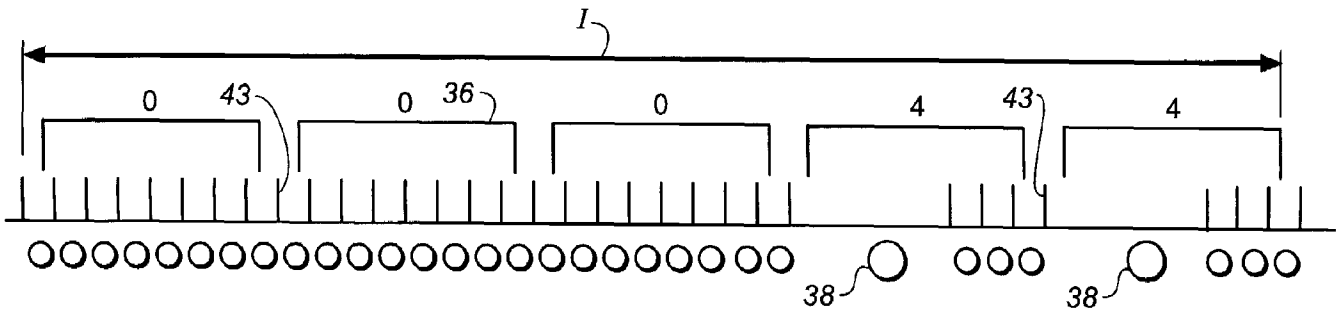
FIGS. 7*a-g* are timing diagrams illustrating different arrangements of droplet formation where two printing droplets are formed having different volumes.
Figure 7B:
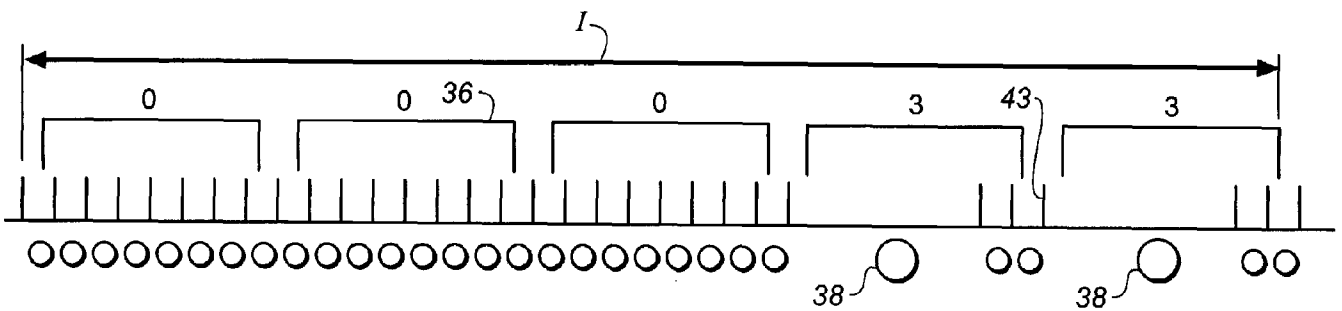
Figure 7C:
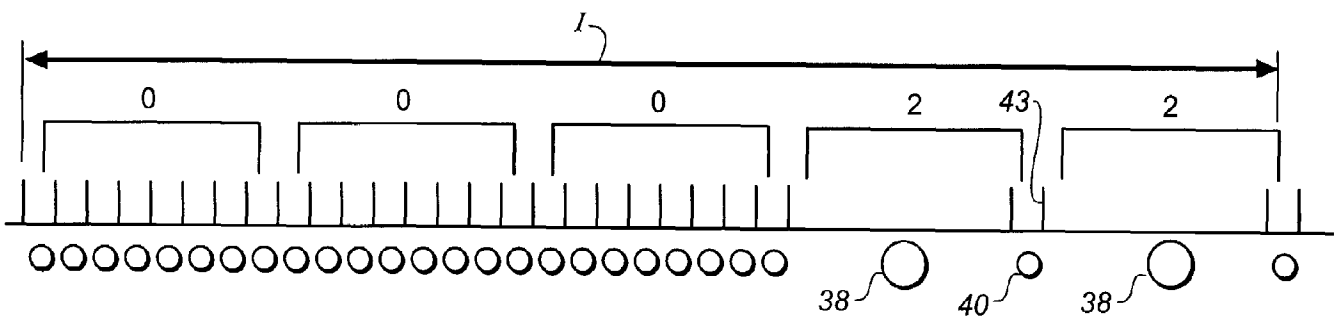
Figure 7D:
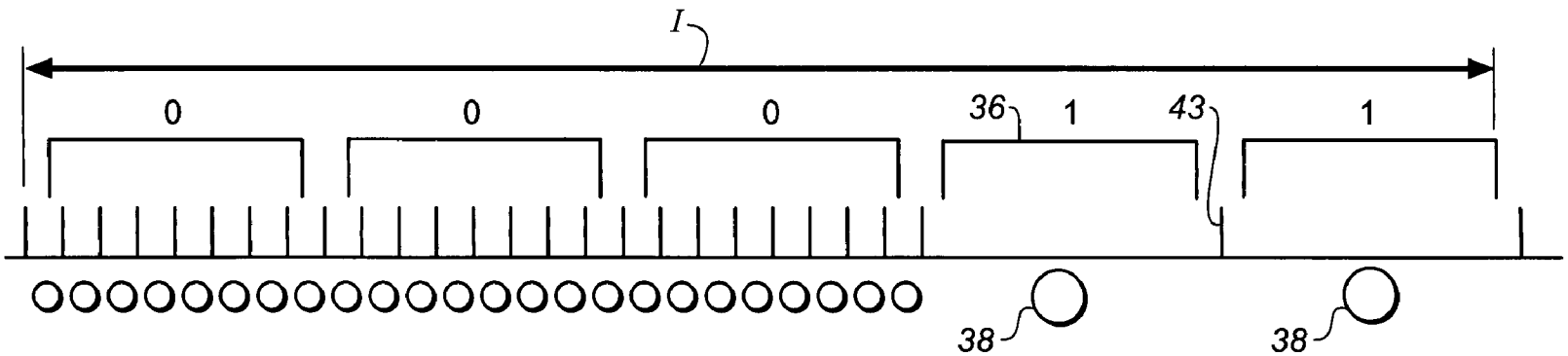
Figure 7E:
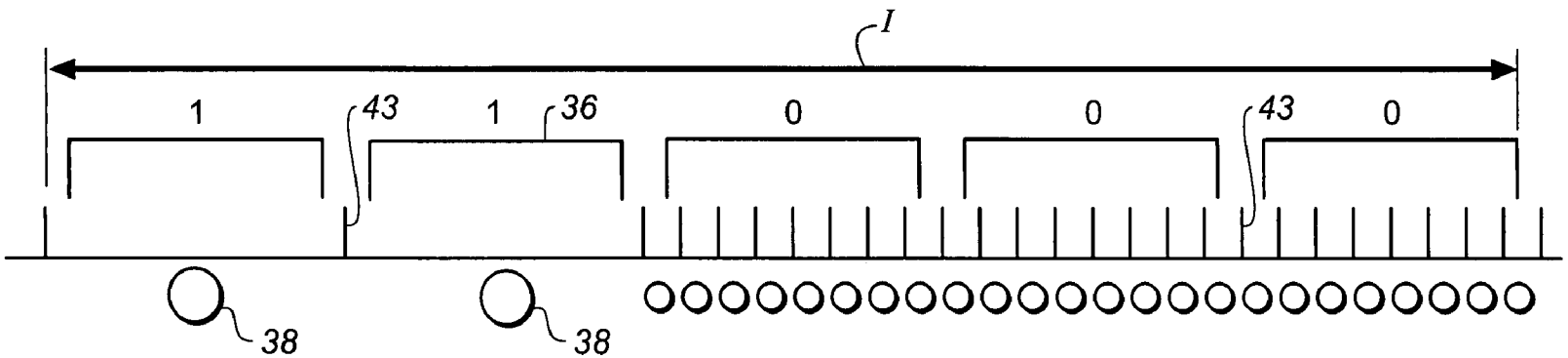
Figure 7F:
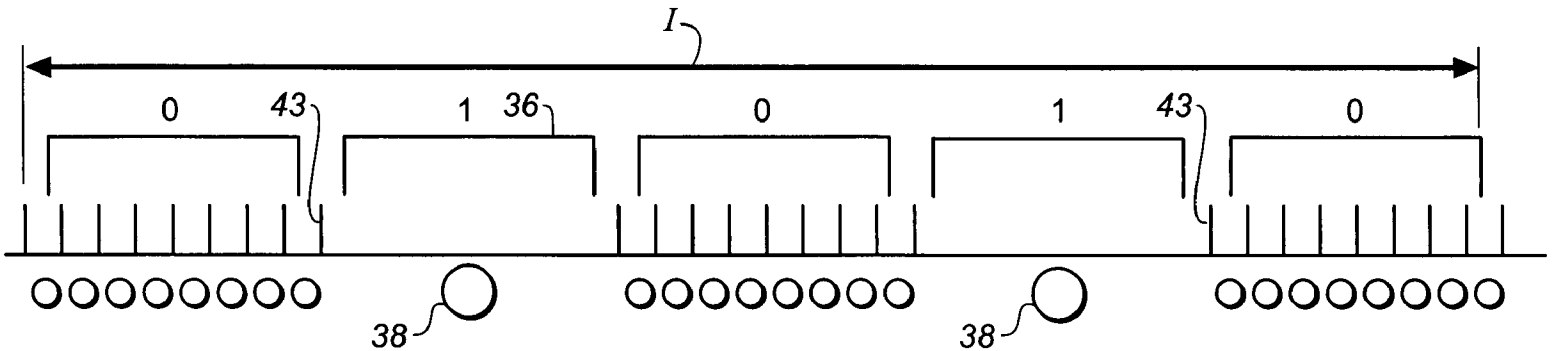
Figure 8A:
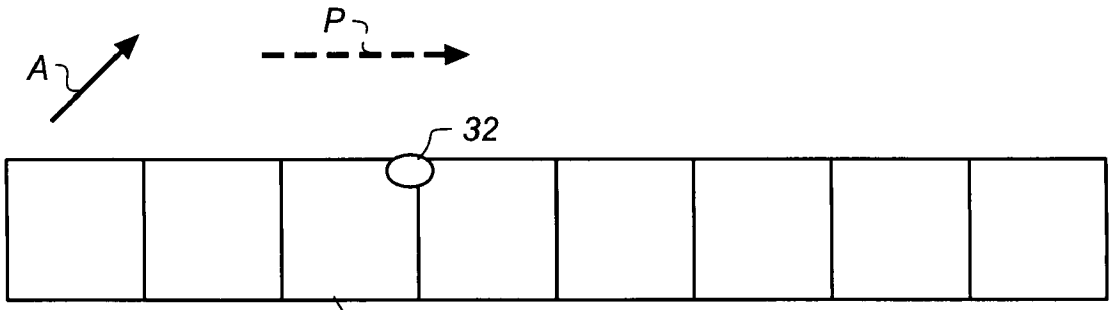
FIGS. 8*a*-8*g* are plan views showing printed drops on pixel areas of a recording medium corresponding to the timing diagrams of FIGS. 7*a*-7*d*, with the print head tilted as in FIG. 6.
Figure 8B:
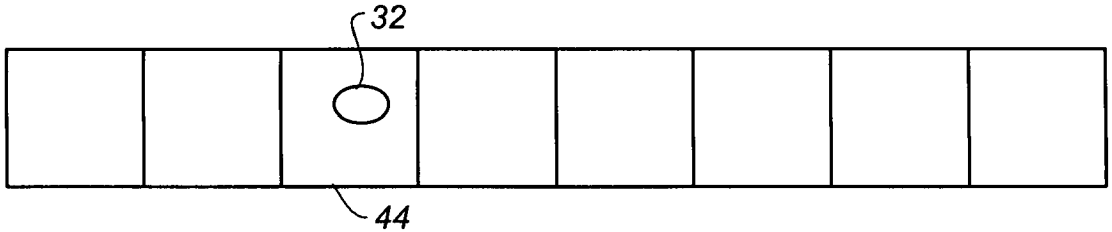
Figure 8C:
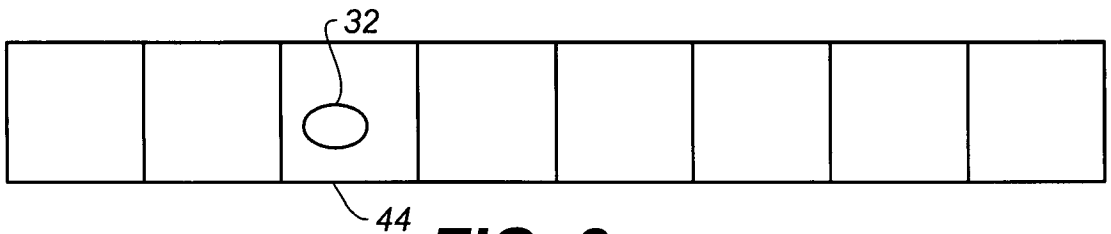
Figure 8D:
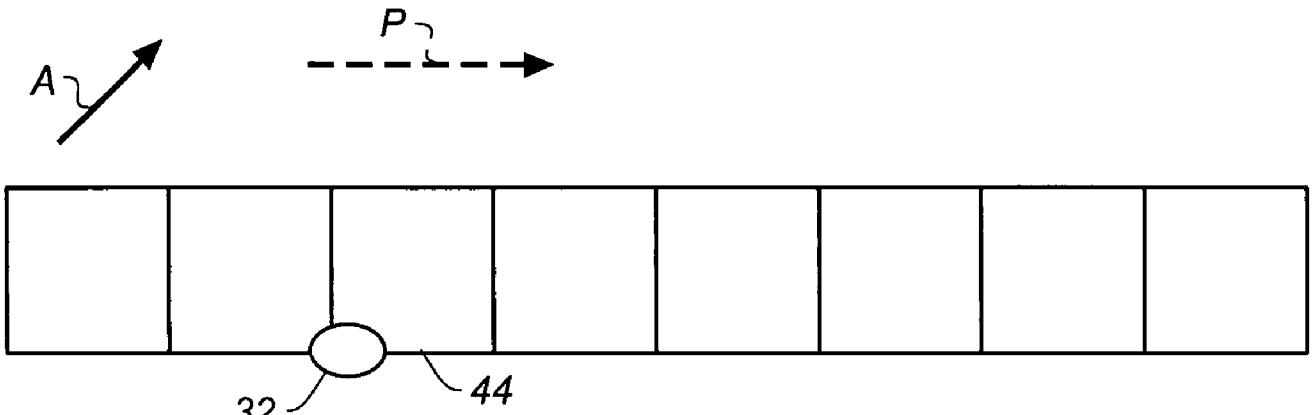
Figure 8E:
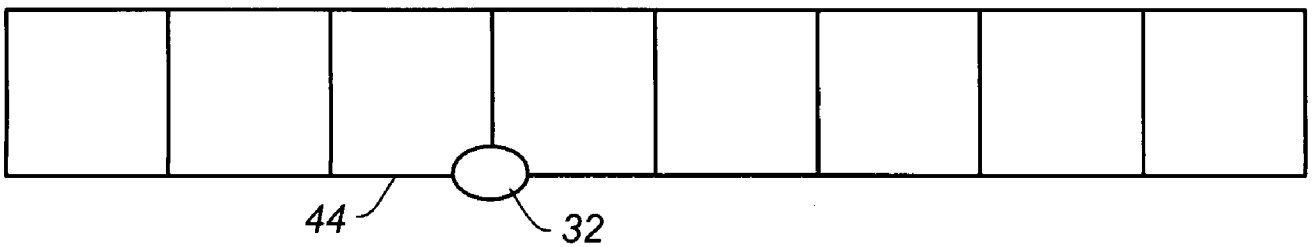
Figure 8F:
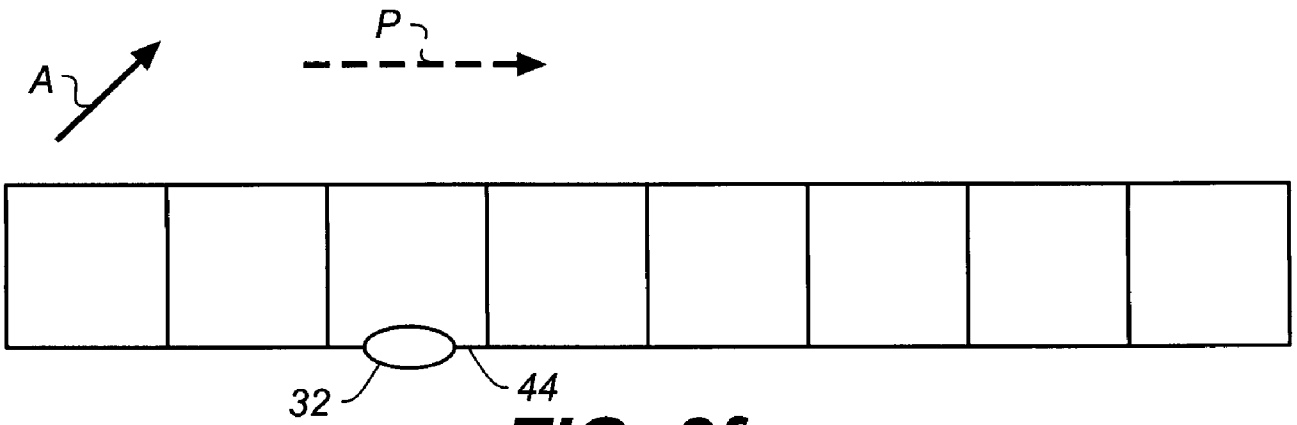

Also by way of illustration, as shown by a comparison of the timing diagrams of FIG. 7*a* with those of FIG. 7*f* and the print plan views of FIG. 8*a* with those of FIG. 8*f*, the elongation of printed drops 38 printed onto recording medium 18 can be changed so that not only the centroid of the printed drop can be caused to lie at any location within its associated pixel area but so that the printed drop may be elongated in the fast scan direction.

Figure 7G:
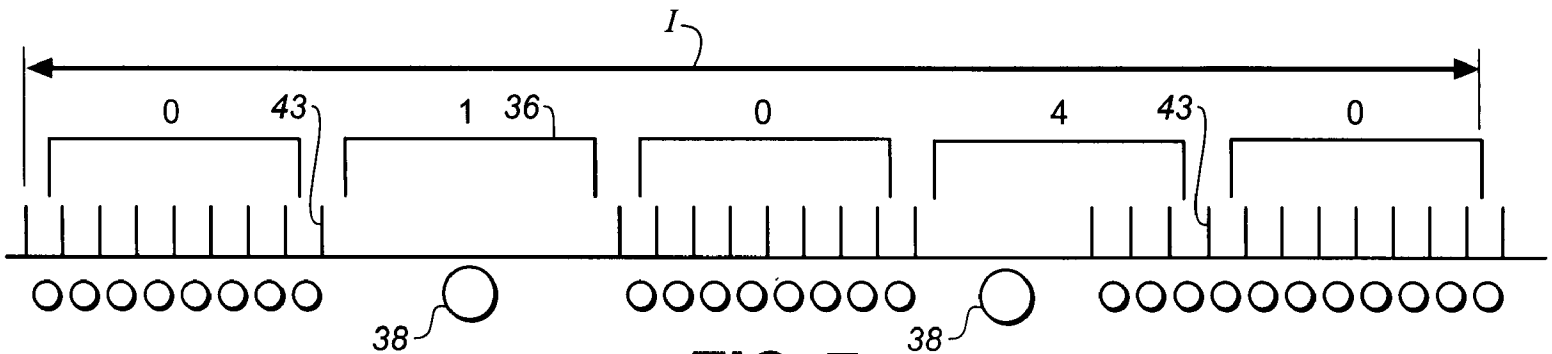
Figure 8G:
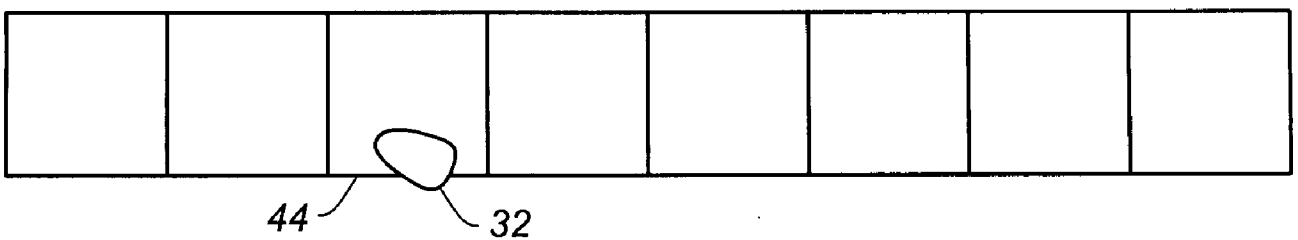

Again by way of illustration, as shown by a comparison of the timing diagrams of FIG. 7*a* with those of FIG. 7*g* and the print plan views of FIG. 8*a* with those of FIG. 8*g*, the printed drop 38 printed onto recording medium 18 can be changed so the printed drop is elongated in an arbitrary direction. As shown in FIG. 8*g*, the elongated drop is slightly pear shaped due to the use of two printing drops of different sizes produced by the pulse sequence of FIG. 7*g*. In some cases, this effect may be beneficial in rendering images; in other cases, the effect is not beneficial and may be compensated by standard diffusion algorithms which maintain the correct ink density averaged over several pixels, as is well known in the art of image processing. With reference to FIG. 1, the timing control exercised for providing the sequences shown in FIGS. 7*a*-7*d* can be provided by image processor 60 and droplet controller 90 using data stored in memory 80.

Thus in general, because the present invention allows positioning of the printing drops 38 comprising printed drops 32 in both the slow and fast scan directions within pixel areas 44, the exemplary sequence FIGS. 7*a*-7*g* when combined with an altered print head 16 angle is particularly advantaged. This advantage may be exploited in various ways to improve image quality. As noted previously, this ability may be used to correct placement errors of printed drops caused by nozzles that produce angular deviations, for example with respect to the printhead surface, in the direction of ejected drops, caused for example by manufacturing defects or debris in or near the nozzle. Alternatively, even for printheads in which nozzles eject drops with no angular deviations, it may be advantageous for image quality to deliberately offset the positions of certain printed drops within their associated pixel areas in order that the pattern of deposited ink more closely resemble the intended image pattern. Thereby the apparent resolution of the printer can be increased, in an imagewise fashion if so desired. The information on what offsets are desired for specific pixels could for example be calculated from very high resolution scans of the image to be printed using the knowledge of the actual number of pixels which will constitute the final printed image, this information being stored in image memory 80 of FIG. 1*a*, as can be appreciated by one skilled in the art of halftone image processing.

Figure 9:
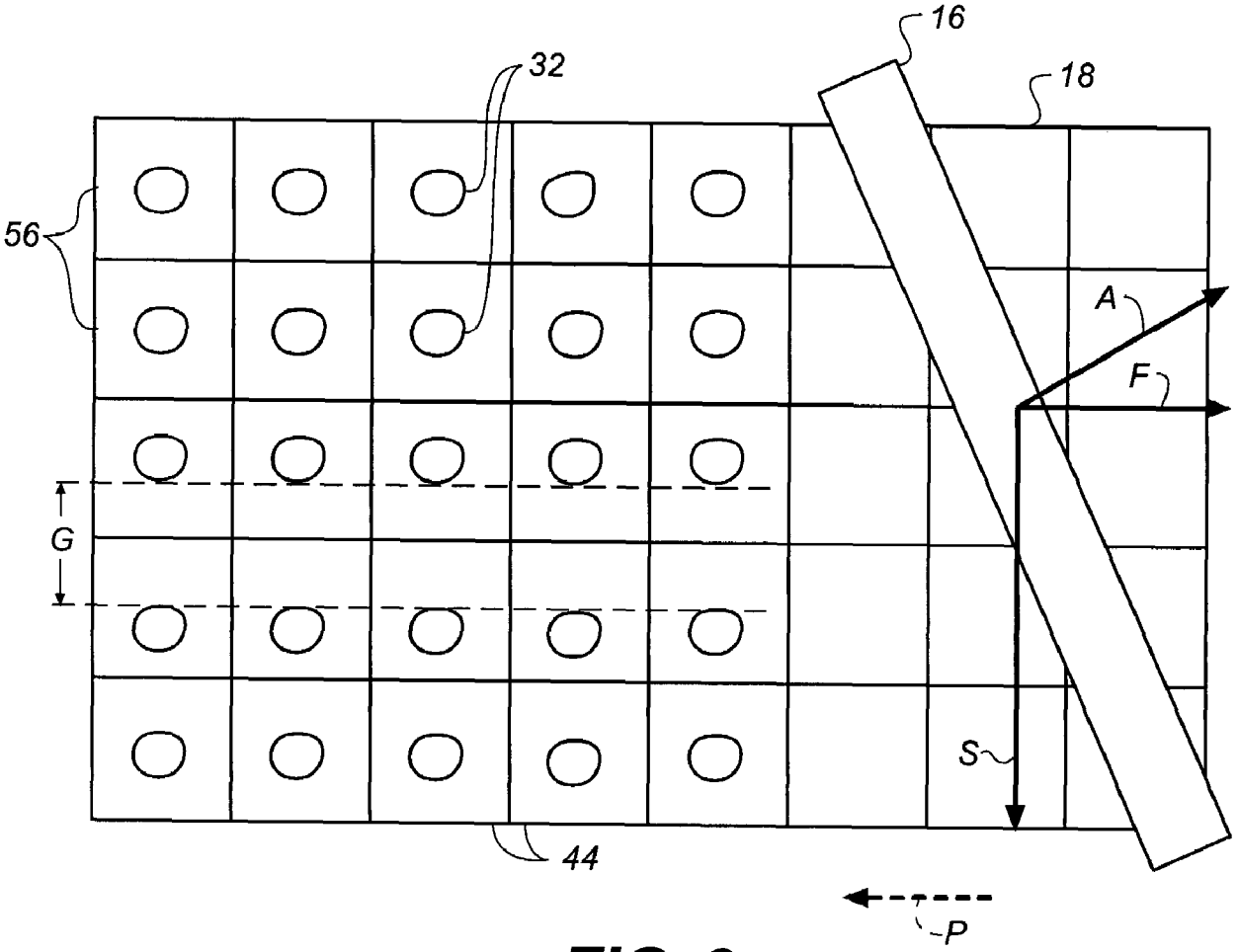
FIG. 9 is a plan view showing a portion of an array of printed drops relative to the position and motion of the print head; two adjacent rows of printed drops inadvertently having a greater than average spacing in the slow scan direction.
Figure 10:
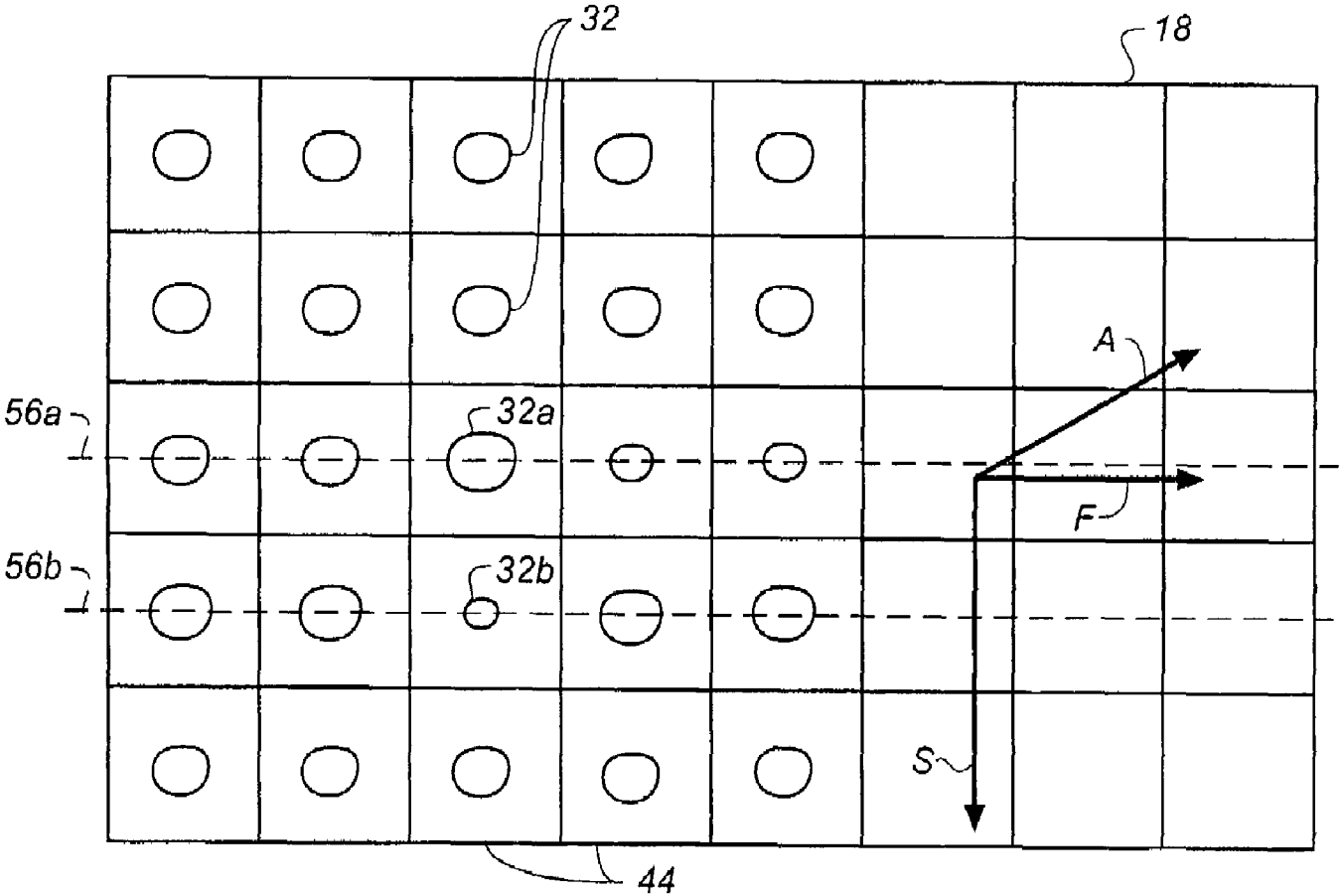
FIG. 10 is a plan view showing a portion of the array of printed drops as in FIG. 9 relative to the position and motion of the print head in which the positions of the printed drops are controlled so as to make the printed drops uniformly spaced apart.

The ability to adjust the position of printed drops in both the fast and slow scan directions in accordance with the present invention is shown in FIGS. 9 and 10 to provide a method for correcting for differences in nozzle to nozzle performance by changing only the algorithms that image processor 60 (FIG. 1*a*) implements to send data to droplet controller 90, as shown in FIGS. 9 and 10, which illustrate correction of a banding artifact using the methods of the current invention.

In FIG. 9, rows of printed drops in their associated pixel areas (each member of the grid of rectangles in FIG. 9) are shown in relation to the angled printed 16 which is moving relative to recording medium 18 in the direction F, to the right in FIG. 9. The airflow which separates printing and non-printing droplets is shown to be in the direction A in FIG. 9. It can be appreciated that the airflow could equally lie in the direction opposite A in FIG. 9, depending on which side of the row of nozzles the gutter of printhead 16 is located. It is also understood that the vertical distance between pixel areas relative to the spacing between nozzles in printhead 16 is given by the cosine of the angle between A and F, as has been described. The rows 56 marked with G indicate rows in which the printed drops lies higher (top dotted line) or lower (bottom dotted line) than would regularly spaced drops. In this example, the spacing of these rows (G) is larger than the vertical distance between pixel areas, here assumed to be square, due, for example, to defects in the manufacture of the nozzles printing printed drops in the rows demarcated G. In this example, the desired pattern of printed drops comprises drops of a constant size, each printed in the center of its respective pixel area. The presence of gap G produces a readily visible artifact, as can be appreciated by one skilled in the art of image processing.

In FIG. 10, the methods in accordance with the present invention have been employed to provide substantial correction to the artifacts of FIG. 9. In particular, altered rows 56*a* and 56*b* now comprise printed drops whose centroids lie in the center of their associated pixel areas. This has been accomplished, as can be appreciated from the discussion of FIGS. 7 and 8, by, in the case of altered row 56*a*, by decreasing the size of printing droplets 32 in altered rows 56*a*, causing displacement of the centroid of printed drops 32 in altered rows 56*a* in the direction A of FIGS. 9 and 10 due to the increased deflection of smaller drops in the direction of airflow A, as discussed in association with FIGS. 7*a*-7*d*, while simultaneously altering the timing of the release of the printed drops so as to occur at earlier times, as discussed in association with FIG. 7*e*. In the case of altered row 56*b*, the change in the position of the centroid of printing drops 32 is accomplished by increasing the size of printing droplets 32 in altered row 56*b*, causing displacement of the centroid of printed drops 32 in altered rows 56*b* in the direction opposite A in FIGS. 9 and 10 due to the decreased deflection of larger drops in the direction of airflow A, as discussed in association with FIGS. 7*a*-7*d*, while simultaneously altering the timing of the release of the printed drops so as to occur at later times, as discussed in association with FIG. 7*f*.

Thus the ability to adjust the position of printed droplets in both the fast and slow scan directions provides a method for correcting for differences in nozzle to nozzle performance using a calibration procedure following these basic steps for each nozzle:

(i) releasing printing drop 38 onto a calibration print with a standard, predetermined timing;

(ii) measuring the error between the ideal and actual positioning of printing drops 38 for this nozzle, based on this standard timing; and, (iii) calculating and storing a calibration correction factor, for example in droplet controller 90, that adjusts nozzle timing for each nozzle to correct for any measured error.

Then, when printing using this nozzle, the calculated calibration correction factor is applied accordingly for the printing of all images. Such a calibration correction factor would typically be stored in a Look-Up Table, here assumed by way of example to reside in image processor 60 (FIG. 1*a*), as is familiar to those skilled in the imaging arts. Following the calibration using the calibration procedure above, the image quality of images other than the calibration print, for example images containing text or photoquality pictures, could be improved by including, for each printed drop, the steps of (iv) calculating, for each pixel area in that image, an additional image dependent drop position correction factor, for example by using any of many well known image processing algorithms designed to hide image artifacts in pictures and/or to smooth the edges of printed text, (v) using the additional image dependent drop position correction factors to additionally adjust droplet timing for droplets printed at each pixel area in order that corrections be made not only to correct for misdirection in either the fast or slow scan directions or timing variations of individual nozzles but also to improve image quality by incorporating image processing algorithms to adjust the position of printed droplets in either the fast or slow scan directions.

It is important to recognize that the use of droplets of slightly varying sizes to adjust drop positions may result in unintended variations of ink density unless measures are taken to determine any lack or excess of ink laydown and compensate for such lack or excess. As is well known in the art of image processing, algorithms such as dithering enable correction in ink laydown over a group or groups of pixels, and the application of such algorithms is within the spirit and intent of the present invention. For example, the printed drops 32*a* and 32*b* in FIG. 10 are shown to have respectively an increased and decreased size, due to incorporation of one more and one less, respectively, printing drop in the respective printed drops. In these cases, the timing of the release of printing drops is respectively advanced and retarded so as to position the printed drop to be centered in the associated pixel in the fast scan direction. In this and other examples discussed, it is assumed that for a nozzle without manufacturing defects, that is a nozzle that does not misplace drops, the center of the associated pixel area for the ejection of a drop is chosen to correspond to a time of drop release approximately in the middle of interval I in FIGS. 3*c*, that is in between the extremes shown respectively by FIGS. 4*a* and 4*b*, corresponding for example to a binary representation designated (000110000) and to have a size corresponding to a value lying between the extremes of FIGS. 7*a* and 7*d*, for example corresponding to FIG. 7*b* or 7*c*, in order that there be a range of adjustment available for advancing or retarding the timing of release and for increasing or decreasing the drop size to alter placement of the centroid of the printed drop in any direction within its pixel area.

Figure 11:
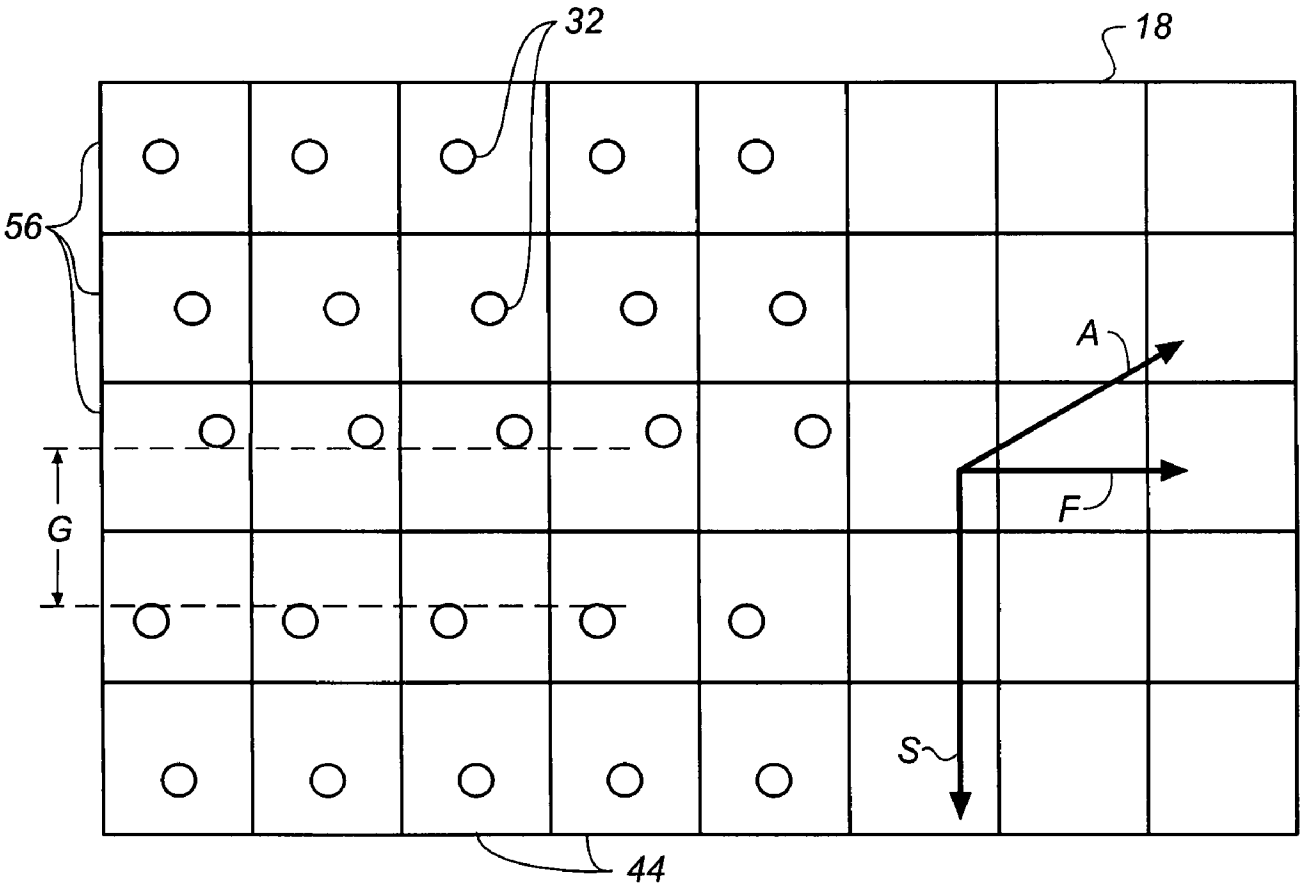
FIG. 11 is a plan view showing a portion of an array of printed drops relative to the position and motion of the print head; the printed drops inadvertently being misplaced in both the slow and fast scan directions.

In FIG. 11, rows of printed drops in their associated pixel areas are shown as in FIG. 9 but for the case of multiple nozzles being misdirected. In this example, the desired pattern of printed comprises drops of a constant size, each printed in the center of its respective pixel area. The presence of gap G as in FIG. 9 and of a periodic misplacement of drops in the direction F in each column of pixel areas produces readily visible artifacts, as can be appreciated by one skilled in the art of image processing. The misplacement of drops in the direction F could arise from either steering inaccuracies associated with the nozzles or from variations in the delay between the time a drop ejection signal is sent to a nozzle and the time drops are ejected.

Figure 12:
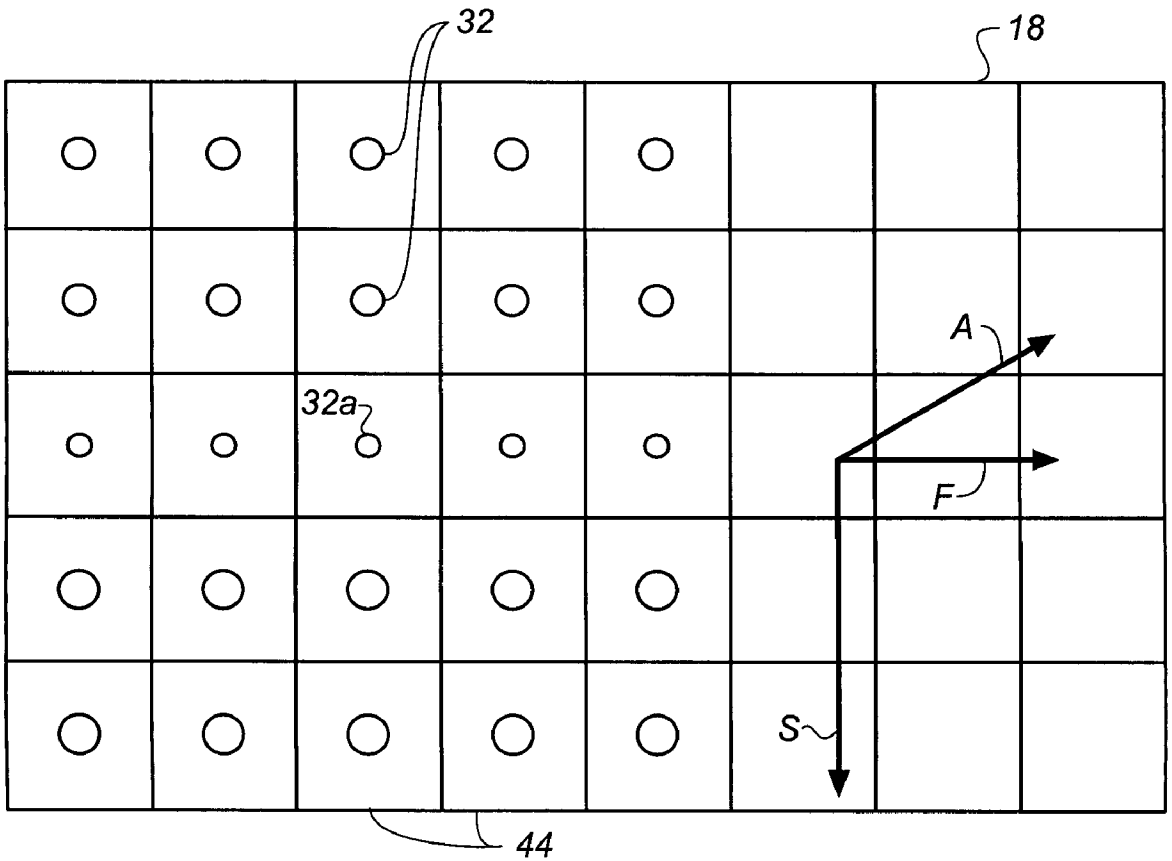
FIG. 12 is a plan view showing a portion of the array of printed drop as in FIG. 11 relative to the position and motion of the print head in which the positions of the printed drops are controlled so as to make the printed drops uniformly spaced apart.

In FIG. 12, the methods in accordance with the present invention have been employed to provide substantial correction to the artifacts of FIG. 11. In particular, the printed drops all have centroids lying in the center of their associated pixel areas. This has been accomplished, as can be appreciated from the discussion of FIGS. 7 and 8, by, in the case of the nozzle printing in the first row from the top of FIG. 11, by delaying the time of ejection of printing drops 38. This could be accomplished, by way of example, by changing a binary representation designated (000110000) to one designated (000011000) for ejecting printing drops printed in the first row. Similarly, in the case of the nozzle printing in the second row from the top of FIG. 11, the time of ejection of printing drops 38 is shown to be advanced in FIG. 12, which could be accomplished, by way of example, by changing and from a binary representation designated (000110000) to one designated (001100000) in the second row. In the case of the third row, the size of the printing drops have been increased and the time of ejection of printing drops has been delayed, etc. Since, in the case of the third row, the printed drops are larger, it may be desirable to compensate this effect by deliberately decreasing the size of printed drops in neighboring regions, either periodically or randomly, as is well known in the art of image processing. This is readily accomplished in accordance with the present invention by reducing the number of printing drops which form a printed drop. Thus the ability to adjust the position of printed droplets in both the fast and slow scan directions provides a method for correcting for differences in nozzle to nozzle performance using a calibration procedure following the basic steps discussed previously.

Figure 13:
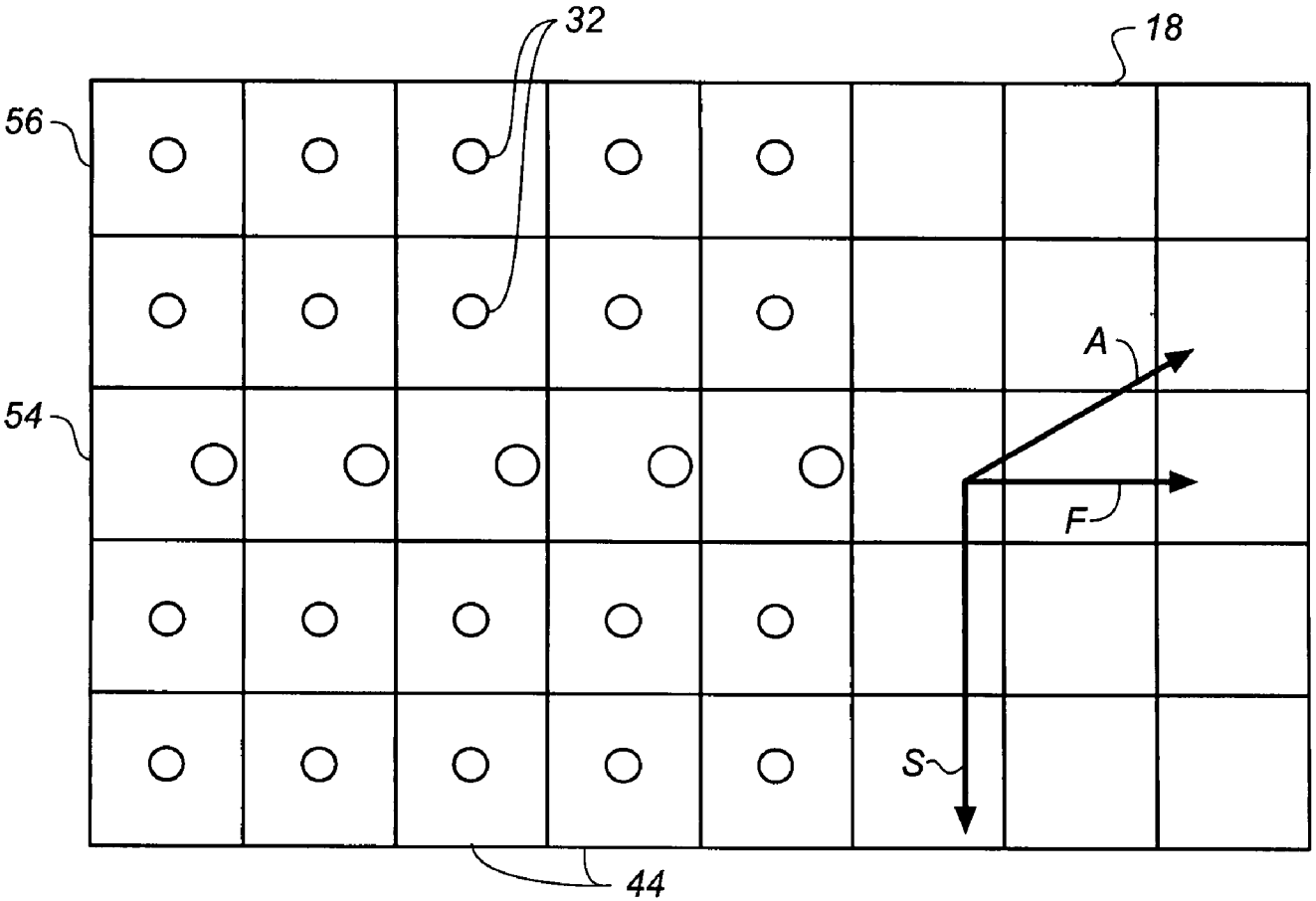
FIG. 13 is a plan view showing a portion of an array of printed droplets; the printed drops inadvertently being misplaced in both the slow and fast scan directions. Additionally, one row of printed drops is irregularly sized.

In FIG. 13, rows of printed drops in their associated pixel areas are shown as in FIG. 9 but for the case of a subset of nozzles being misdirected and one nozzle (that printing drops in the third row from the to of FIG. 13) that exceed the expected drop volume. In this example, the desired pattern of printed comprises drops of a constant size, each printed in the center of its respective pixel area. The combination of misdirected nozzles and drop volume variation produces readily visible artifact, as can be appreciated by one skilled in the art of image processing. The misplacement of the large drops in the third row could arise from either steering inaccuracies associated with the nozzles or from variations in the delay between the time a drop ejection signal is sent to a nozzle and the time drops are ejected.

Figure 14:
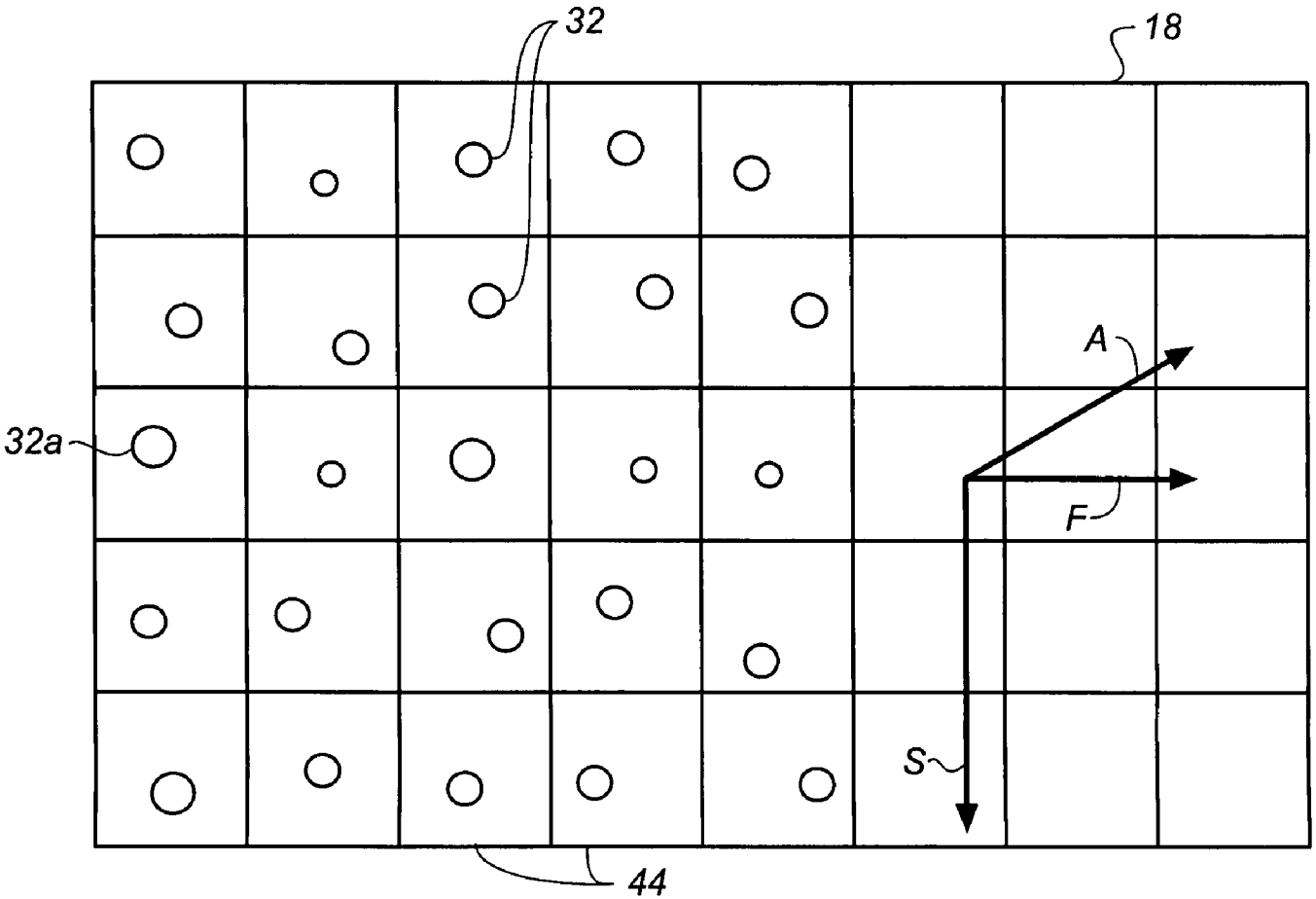
FIG. 14 is a plan view showing a portion of the array of printed droplets as in FIG. 13 now having a randomized arrangement using the method of the present invention.

In FIG. 14, the methods in accordance with the present invention have been employed to hide at least a portion of the artifacts of FIG. 12. In particular, the printed drops have been altered randomly as to both the value of their timing (either retardation or advancement) and their volume (either increased or decreased volume). This can be accomplished, as can be appreciated from the discussion of FIGS. 7 and 8, by randomly delaying or advancing the time of ejection of printing drops 38 and by randomly incrementing or decrementing the volume size. As is well known in the art of image processing, while the resulting image is not exactly the desired pattern, the presence of random noise reduces the objectionablility of the artifacts. Significantly, using the method of the present invention, the capability for precision placement of printed drop 32 is available at each individual nozzle of print head 16 and with the formation of each individual printed drop 32 from each nozzle. This means that, unlike previous print head designs, print head 16 of the present invention can perform dithering or add random spatial noise to its printing pattern. It is of course understood that algorithms other that those introducing random choices for timing and volume "noise" may be used to further decrease the appearance of objectionable artifacts, as is well known in the art of image processing, the precise nature of which is not the topic of the current invention. For example, in FIG. 14 the first printed drop in the third row from the top is substantially larger than the desired printed drop size, as a result of a random choice for is volume, and may itself represent a visible artifact. It is within the intended scope and purpose of the present invention that further algorithms, not of a random nature, might have alternatively been applied to recognize such potential image artifacts and mitigate them, for example by reducing the number of printing drops comprising printed drop 32 in FIG. 14, particularly, as is well known in the art of error diffusion, in which the probability of such an alteration preserves to a maximum extent the average desired volume of printed drops in the neighborhood of printed drop 32*a*.

Thus the ability to adjust the position of printed droplets in both the fast and slow scan directions again is shown to provide a method for correcting for differences in nozzle to nozzle performance. A calibration procedure following the basic steps discussed previously in combination with image processing algorithms stored and executed in image processor 60 (FIG. 1*a*) thus enables a simple and cost effective means of improving image quality. Alteration or improvement of such means is within the scope of the present invention, particularly to be noted is the opportunity for such improvements enabled by eh present invention that require only changes in the programming of image processor 60.

Figure 15:
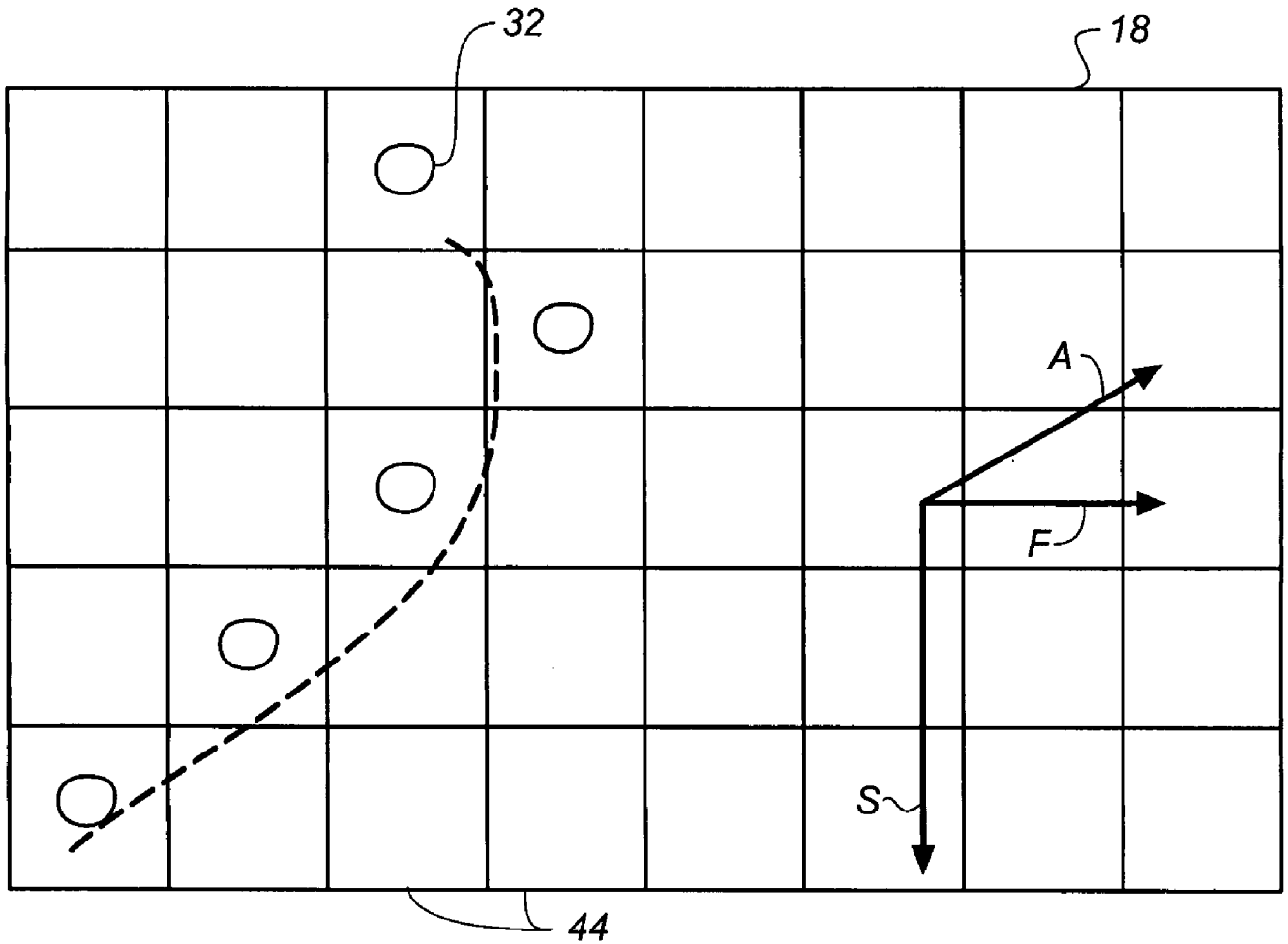
FIG. 15 is a plan view showing side-by-side portions of an array of printed droplets uniformly spaced within pixel areas printed to form a portion of text.

In FIG. 15, rows of printed drops in their associated pixel areas are shown as in FIG. 9 but for the case of printing of text or other graphic figure. In this example, as opposed to the previously discussed preferred embodiments, it is assumed that no nozzles are misdirected and that there are no drop volume variations amongst nozzles. However, the portion of the text as render in FIG. 15 is not ideal, because of limitations of resolution and drop position, as is well known in the graphic reproduction arts. The dotted line in FIG. 15 traces the desired figure line of the centroid of printed drops for the portion of text desired to be printed. The departure of the drop centers from the dotted line represents an image artifact from the point of view of graphic printing.

Figure 16:
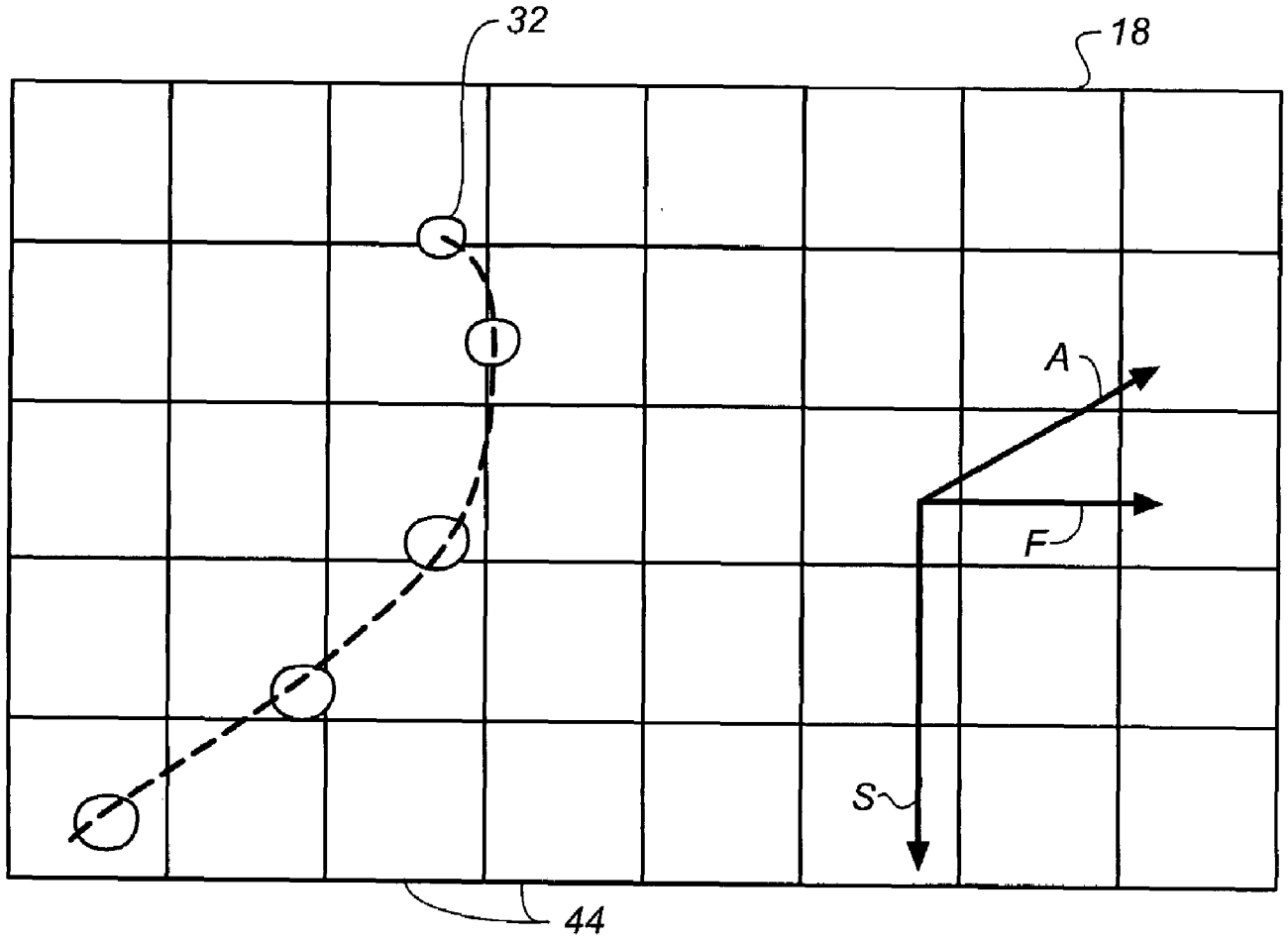
FIG. 16 is a plan view showing side-by-side portions of the array of printed droplets of FIG. 15 but with the position of drops deliberately altered to increase image quality.

In FIG. 16, the methods in accordance with the present invention have been employed to hide at least a portion of the artifacts of FIG. 15. In particular, the printed drops have been altered in the position of their centroid locations so that the centroid positions more closely follow the desired figure line. Thereby, the quality of the printed text is improved. The information as to how the centroid locations are to be altered can be calculated by algorithms incorporated, for example, in the function of image processor 60, FIG. 1*a* or stored in memory 80.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. For example, while the examples shown in FIGS. 9*a*-9*c* subdivide printed drop interval I into 40 subintervals, some other arrangement of subintervals could be used. Other methods of ink stream deflection could alternately be employed, including the use of electrostatic force. It should be noted that while a diagonal angular orientation of about 45 degrees of print head 16 relative to fast scan is shown in FIG. 6, other angles could be used. For example, angles over a range from about 10 degrees to about 80 degrees could be advantaged for rotation of print head 16 relative to fast scan direction F. It can be thus appreciated that the angle of print head 16 relative to fast scan direction F, can be simply changed in order to optimize the principals taught in the present invention, as can the number of intervals I, subintervals 34, and blocks 36 within interval I. It should also be noted the while the present invention is described in terms of the shaping and positioning of printed drops within their associated pixel areas, it is understood that drops may be positioned on or slightly over the boundaries between pixel areas. It is also within the scope and intent of the present invention that the centers of the pixel areas associated with printing drops ejected from particular nozzles can be defined in a variety of substantially equivalent ways, as can be appreciated by one skilled in printing images. For example, the center of a pixel area might be taken to correspond to the location of a single printing drop of a particular size released at the timing midpoint during interval I in FIG. 3*a*.

Thus, what is provided is an apparatus and method for improved control of printed drop placement on the recording medium in a continuous inkjet printer, allowing a print head to compensate for mechanical and dimensional artifacts by exercising timing and deflection control at each individual print head nozzle.

The invention has been described in detail with particular reference to certain preferred embodiments thereof, but it will be understood that variations and modifications can be effected within the spirit and scope of the invention.

| PARTS LIST: | |
|---|---|
| 10. | Printer system |
| 14. | Heater control circuits |
| 15. | Substrate |
| 16. | Printhead |
| 17. | Ink gutter |
| 18. | Recording medium |
| 19. | Ink |
| 20. | Medium transport system |
| 21. | Nozzles |
| 22. | Heater |
| 24. | Micro controller |
| 26. | Ink pressure regulator |
| 28. | Reservoir |
| 30. | Ink channel |
| 32. | Printed drop |
| 32a. | Altered printed drop |
| 32b. | Altered printed drop |

-continued

| PARTS LIST: | |
|---|---|
| 34. | Subinterval |
| 36. | Block |
| 38. | Printing droplet |
| 40. | Non-printing droplet |
| 42. | Drop forming pulse or pulse |
| 43. | Drop forming pulse or pulse |
| 44. | Pixel areas |
| 48. | Deflection means |
| 50. | Image source |
| 56. | Row |
| 56a. | Altered row |
| 56b. | Altered row |
| 60. | Image processor |
| 80. | Image memory |
| 90. | Droplet controller |
| 100. | Recording medium transport roller |
| 110. | Transport control system |
| 120. | Logic controller |
| 150. | Ink conduit |
| A. | Deflecting air flow |
| C. | Centroid |
| I. | Printed drop interval |
| F. | Fast scan direction |
| S. | Slow scan direction |
| T. | G. Gap |

The invention claimed is:

1. A method of printing comprising the steps of:

a. providing a recording medium including a grid of pixel areas;

b. providing a travel path of a movable printhead comprising a direction of motion of the printhead with respect to the recording medium, the printhead having a linear array of nozzles and being tilted with respect to the travel path so that the liner array is tilted at a nonzero angle relative to the travel path;

c. associating a single pixel area of the grid of pixel areas with a corresponding nozzle of the linear array and with a time interval during which a drop ejected from the corresponding nozzle can impinge the single pixel area;

d. dividing the time interval into a plurality of subintervals;

e. grouping the plurality of subintervals into blocks;

f. associating one of two labels with each block, the first label defining a printing drop and the second label defining non-printing drops;

g. associating a drop forming pulse only between consecutive selected subintervals, not each subinterval, of blocks having the first label;

h. associating a drop forming pulse between each subinterval of each block having the second label;

i. associating a drop forming pulse between other subintervals not in steps g. and h., the drop forming pulse in step i. being only between each pair of consecutive blocks, and the drop forming pulse in steps g. and h. being only within the blocks;

j. causing drops to be ejected from the corresponding nozzle based on the associated drop forming pulses; and k. repeating steps c. through j. for each single pixel area that remains in the grid of pixel areas.

2. The method according to claim 1, wherein each subinterval is of the same duration.

3. The method according to claim 1, wherein each block include the same number of subintervals.

4. The method according to claim 1, wherein no subinterval is completely positioned between successive blocks.

5. The method according to claim 1, a printed drop comprising an integral number of printing drops, the method further comprising:

obtaining a desired fluid volume of the printed drop located within the pixel area from print data;

associating the first label with a number of blocks of the time interval and associating the second label with any remaining blocks of the time interval based on the fluid volume of the printed drop; and associating with each block associated with the first label the number of drop forming pulses between consecutive selected subintervals of the block having the first label such that the volume of the printed drop substantially equals the desired fluid volume of the printed drop.

6. The method according to claim 5, wherein the number of blocks associated with the first label comprises zero blocks.

7. The method according to claim 5, wherein the number of blocks associated with the first label comprises one block.

8. The method according to claim 7, further comprising:

obtaining a location of the printed drop located within the pixel area from print data;

ordering the block associated with the first label and any remaining blocks associated with the second label based on the location of the printed drop; and determining for each block associated with the first label a number of consecutive selected subintervals.

9. The method according to claim 5, wherein the number of blocks associated with the first label comprises a number of blocks that is greater than one.

10. The method according to claim 9, wherein the plurality of blocks associated with the first label are consecutive.

11. The method according to claim 10, further comprising:

obtaining a location of the printed drop located within the pixel area from print data; and ordering the plurality of blocks associated with the first label and any remaining blocks associated with the second label based on the location of the printed drop.

12. The method according to claim 9, further comprising:

obtaining a shape of the printed drop located within the pixel area from print data; and ordering the plurality of blocks associated with the first label such that one block associated with the first label is spaced apart from another block associated with the first label by at least one block associated with the second label.

13. The method according to claim 12, further comprising:

ordering the plurality of blocks associated with the first label such that one block associated with the first label is spaced apart from another block associated with the first label by additional drop forming pulses associated between other subintervals.

14. The method according to claim 1, wherein the number of drop forming pulses between consecutive selected subintervals of the block having the first label is zero.

15. The method according to claim 1, wherein the number of drop forming pulses between consecutive selected subintervals of the block having the first label is one.

16. The method according to claim 1, wherein the number of drop forming pulses between consecutive selected subintervals of the block having the first label is a number of drop forming pulses that is greater than one.

17. The method according to claim 1, wherein the number of drop forming pulses between consecutive selected subintervals of the block having the first label is a number of drop forming pulses that is less than the number of subintervals grouped in the block having the first label.

18. A method of correcting printed drop placement on a recording medium comprising:

identifying a printed drop placement error; and correcting the printed drop placement error using the method of claim 1.

19. The method according to claim 18, wherein the printed drop placement error is caused by a defect in the printhead.

20. The method according to claim 18, wherein collecting the printed drop placement error introduces random variations in the placement of the printed drop within one pixel area as compared to the printed drop of another pixel area.

21. The method according to claim 9, further comprising:

obtaining a shape of the printed drop located within the pixel area from print data; and altering the number of consecutive selected subintervals in blocks having the first label such that the printed drop is elongated in a direction of the nonzero angle.

22. A method of printing comprising:

obtaining an offset location of a printed drop located within a pixel area from print data; and causing the printed drop to be placed at the offset location using the method of claim 1.

23. The method according to claim 1, the drop forming pulse between each pair of consecutive blocks having a form, the drop forming pulse associated with one of the block having the first label and the block having the second label having a form, wherein the form of the drop forming pulse between each pair of consecutive blocks is not equivalent to the form of the drop forming pulse associated with one of the block having the first label and the block having the second label.

24. The method according to claim 1, the printing drops including a volume, the non-printing drops including a volume, wherein the volume of the printing drops is larger than the volume of the non-printing drops.

25. The method according to claim 1, wherein the single pixel area is square.

* * * * *

UNITED STATES PATENT AND TRADEMARK OFFICE

CERTIFICATE OF CORRECTION

PATENT NO. : 7,273,269 B2
APPLICATION NO. : 10/903051
DATED : September 25, 2007
INVENTOR(S) : Gilbert A. Hawkins et al.

It is certified that error appears in the above-identified patent and that said Letters Patent is hereby corrected as shown below:

| | |
|---|---|
| Column 19, Line 45 | In Claim 1, after "drop" insert -- , --. |
| Column 21, Line 14 | In Claim 20, delete "collecting" and insert -- correcting --. |

Signed and Sealed this

Sixth Day of May, 2008

JON W. DUDAS
*Director of the United States Patent and Trademark Office*